US011226579B2

(12) United States Patent
Nakano et al.

(10) Patent No.: US 11,226,579 B2
(45) Date of Patent: Jan. 18, 2022

(54) IMAGE FORMING APPARATUS

(71) Applicant: BROTHER KOGYO KABUSHIKI KAISHA, Nagoya (JP)

(72) Inventors: Hiroshi Nakano, Aichi (JP); Yusuke Ikegami, Aichi (JP); Shoichiro Nishimura, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/198,998

(22) Filed: Mar. 11, 2021

(65) Prior Publication Data

US 2021/0325811 A1 Oct. 21, 2021

(30) Foreign Application Priority Data

Apr. 15, 2020 (JP) ..... JP2020-073078

(51) Int. Cl.
*G03G 15/08* (2006.01)
*G03G 15/00* (2006.01)

(52) U.S. Cl.
CPC ..... *G03G 15/757* (2013.01); *G03G 15/0808* (2013.01)

(58) Field of Classification Search
CPC ..... G03G 15/757; G03G 15/0808
See application file for complete search history.

(56) References Cited

U.S. PATENT DOCUMENTS 7,983,600 B2 * 7/2011 Abe ..... G03G 15/0194 399/167
9,448,524 B2 * 9/2016 Ino ..... G03G 21/1857
2005/0013629 A1 * 1/2005 Ito ..... G03G 21/168 399/116
2012/0008985 A1 * 1/2012 Park ..... F16H 55/0886 399/167
2015/0362883 A1 * 12/2015 Sim ..... G03G 15/757 399/167
2016/0349664 A1 12/2016 Sawashima
2019/0161300 A1 * 5/2019 Katto ..... G03G 15/6529
2020/0004198 A1 * 1/2020 Nakano ..... G03G 21/1814
2021/0011420 A1 * 1/2021 Haruta ..... G03G 21/1857

FOREIGN PATENT DOCUMENTS

JP 2016-224418 A 12/2016

* cited by examiner

*Primary Examiner* — Sevan A Aydin
(74) *Attorney, Agent, or Firm* — Merchant & Gould P.C.

(57) ABSTRACT

An image forming apparatus, having first, second, third, and fourth photosensitive drums, first, second, third, and fourth developing rollers, a development-driving gear, a development motor, a first development gear train having a first gear, a second development-gear train having a second gear, a process-driving gear, a process motor, a first process-gear train having a third gear, and a second process gear-train having a fourth gear, is provided. The first development-gear train transmits a driving force from the development motor to the first and second developing rollers. The second development-gear train transmits the driving force from the development motor to the third and fourth developing rollers. The first process-gear train transmits a driving force from the process motor to the first and second photosensitive drums. The second process-gear train transmits the driving force from the process motor to the third and fourth photosensitive drums.

13 Claims, 12 Drawing Sheets

IMAGE FORMING APPARATUS

CROSS REFERENCE TO RELATED APPLICATION

This application claims priority from Japanese Patent Application No. 2020-073078, filed on Apr. 15, 2020, the entire subject matter of which is incorporated herein by reference.

BACKGROUND

Technical Field

An aspect of the present disclosure is related to an image forming apparatus, having a plurality of photosensitive drums and a plurality of developing rollers which correspond to the plurality of photosensitive drums on one-to-one basis.

Related Art

An image forming apparatus for forming images in colors of yellow, magenta, cyan, and black is known. The image forming apparatus may have four (4) developing rollers for the four colors, a first gear train, and a second gear train. The first gear train may transmit a driving force from a motor to three (3) of the developing rollers corresponding to the colors of yellow, magenta, and cyan, and the second gear train may transmit the driving force from the same motor to one of the developing rollers corresponding to the color of black.

SUMMARY

In the known image forming apparatus, gears in the first gear train to transmit the driving force from the development motor to the three developing rollers may be subject to a greater intensity of torque. In particular, an intensity of torque to act on multi-wheeler gears arranged on an upstream position in the first gear train may be greater and may cause deformation of teeth in the gears. Deformation of the teeth in the gears may lower a transmission efficiency; therefore, in order to resist the burden of the greater torque, the for example, a thickness of the gear may be increased so that the intensity of the burden per unit thickness may be reduced. With the thickened gear, however, a volume of the gear may be increased, and manufacturing cost for the gears may increase. As a result, a volume and a manufacturing cost for a driving-force transmission mechanism for transmitting the driving force from the motor may increase.

The present disclosure is advantageous in that an image forming apparatus, in which a volume and a manufacturing cost for a driving-force transmission mechanism for transmitting a driving force from a motor may be reduced, is provided.

According to an aspect of the present disclosure, an image forming apparatus, having a first photosensitive drum, a second photosensitive drum, a third photosensitive drum, a fourth photosensitive drum, a first developing roller configured to supply toner to the first photosensitive drum, a second developing roller configured to supply toner to the second photosensitive drum, a third developing roller configured to supply toner to the third photosensitive drum, a fourth developing roller configured to supply toner to the fourth photosensitive drum, a development-driving gear, a development motor configured to drive the development-driving gear, a first development-gear train having a first gear meshing directly with the development-driving gear, a second development-gear train having a second gear meshing directly with the development-driving gear, a process-driving gear, a process motor configured to drive the process-driving gear, a first process-gear train having a third gear meshing directly with the process-driving gear, and a second process-gear train having a fourth gear meshing directly with the process-driving gear, is provided. The first development-gear train is configured to transmit a driving force from the development motor to the first developing roller and the second developing roller. The second development-gear train is configured to transmit the driving force from the development motor to the third developing roller and the fourth developing roller. The second development-gear train is provided separately from the first development-gear train. The first process-gear train is configured to transmit a driving force from the process motor to the first photosensitive drum and the second photosensitive drum. The second process-gear train is configured to transmit the driving force from the process motor to the third photosensitive drum and the fourth photosensitive drum. The second process-gear train is provided separately from the first process-gear train.

BRIEF DESCRIPTION OF THE ACCOMPANYING DRAWINGS

DETAILED DESCRIPTION

Hereinafter, an embodiment of the present disclosure will be described with reference to the accompanying drawings.

Figure 1:
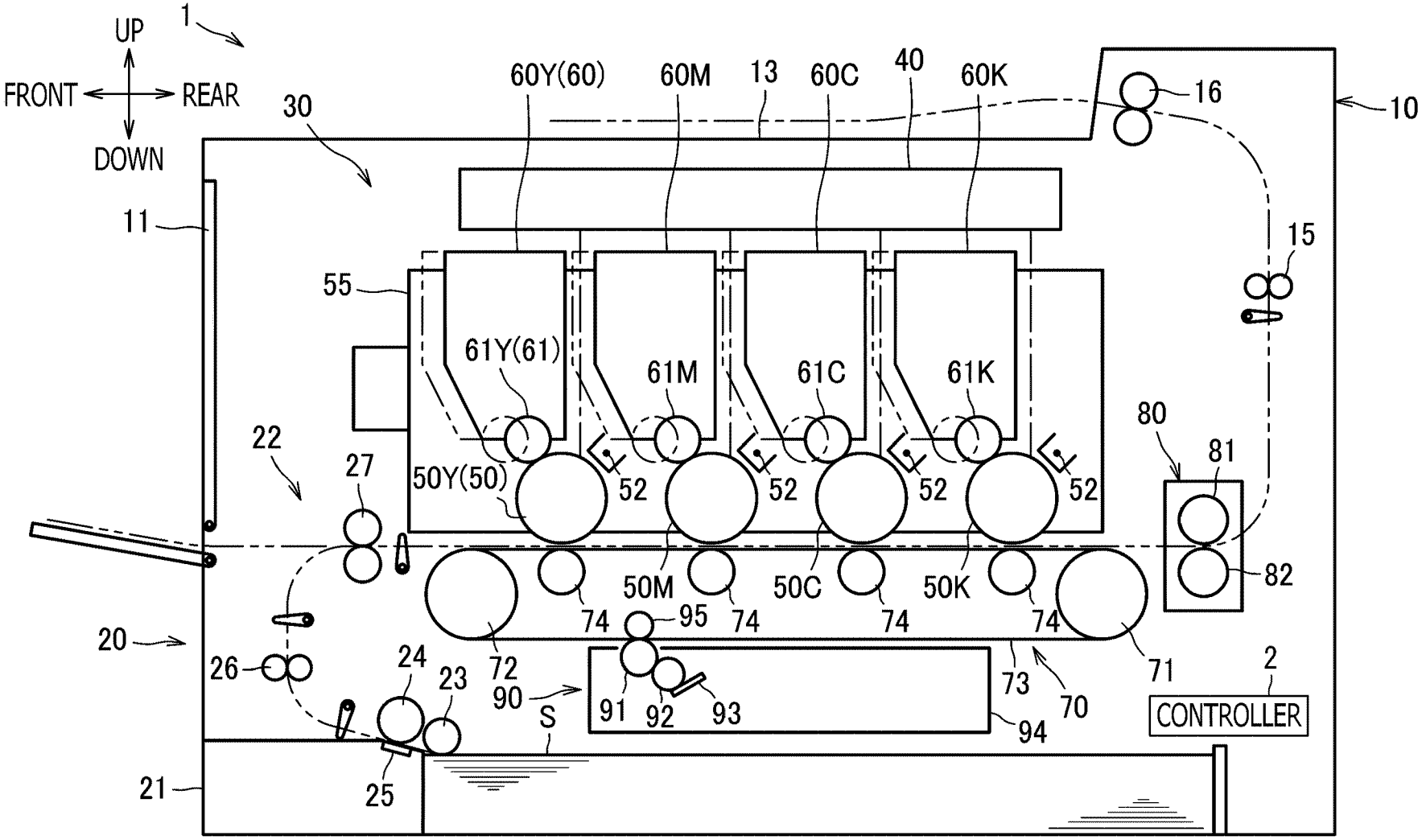
FIG. 1 is an overall cross-sectional view of an image forming apparatus according to an embodiment of the present disclosure.

As shown in FIG. 1, an image forming apparatus 1 according to the embodiment is a multicolor printer and has a casing 10, a sheet feeder 20, an image forming device 30, a belt cleaning device 90, and a controller 2. In the following description, directions related the image forming apparatus 1 and each part or item included in the image forming apparatus 1 will be referred to on basis of indications by arrows in the drawings. For example, in FIG. 1, a viewer's a left-hand side, a right-hand side, an upper side, and a lower side will be referred to as a front side, a rear side, an upper side, and a lower side, respectively. Moreover, a farther side and a nearer side to the viewer viewing FIG. 1 will be referred to as a leftward side and a rightward side to the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction.

The sheet feeder 20 includes a sheet tray 21 to store sheets S and a feeder device 22. The sheet tray 21 is arranged at a position below the image forming device 30 and is movable to be pulled frontward, e.g., leftward in FIG. 1, to be detached from the casing 10. The feeder device 22 includes a feeder roller 23, a separator roller 24, a separator pad 25, a conveyer roller 26, and a registration roller 27. The sheet(s) S in the present embodiment is a printing medium, on which the image forming apparatus 1 may form an image, and includes, but not necessarily be limited to, regular paper, envelope, postcard, tracing paper, cardboard, resin sheet, and sticker sheet.

The sheets S stored in the sheet tray 21 may be picked up by the feeder roller 23, separated one by one from the other sheets S by the separator roller 24 and the separator pad 25, and conveyed by the conveyer roller 26 to the registration roller 27. As the separated sheet S is conveyed further, a position of a leading edge of the sheet S may be regulated by the registration roller 27, which may be pausing. Thereafter, as the registration roller 27 starts rotating, the sheet S may be fed to the image forming device 30.

The image forming device 30 includes an exposure device 40, a plurality of photosensitive drums 50, a plurality of developing cartridges 60, a conveyer 70, and a fuser 80.

The exposure device 40 includes laser diodes, deflectors, lenses, and mirrors, which are not shown. The exposure device 40 may emit laser beams at the photosensitive drums 50 to expose the photosensitive drums 50 to the light and to scan surfaces of the photosensitive drums 50.

The photosensitive drums 50 include a Y-photosensitive drum 50Y, an M-photosensitive drum 50M, a C-photosensitive drum 50C, and a K-photosensitive drum 50K, which are provided to correspond to colors of yellow, magenta, cyan, and black on one-to-one basis. In the following paragraphs and the accompanying drawings, a color to which an item corresponds may be identified by a suffix Y, M, C, or K, representing yellow, magenta, cyan, or black, respectively, appended to a reference sign of the item. On the other hand, when items are described generally without necessity of referring to the corresponding colors thereto, the items may be described collectively in a singular form with a single reference sign without the suffix Y, M, C, or K; and the prefix signs Y-, M-, C-, and K- may be omitted.

The developing cartridge 60 is provided correspondingly to the photosensitive drum 50. In particular, the developing cartridge 60 includes a Y-developing cartridge 60Y, an M-developing cartridge 60M, a C-developing cartridge 60C, and a K-developing cartridge 60K. The Y-developing cartridge 60Y includes a Y-developing roller 61Y, which may supply yellow toner to the Y-photosensitive drum 50Y The M-developing cartridge 60M includes an M-developing roller 61M, which may supply magenta toner to the M-photosensitive drum 50M. The C-developing cartridge 60C includes a C-developing roller 61C, which may supply cyan toner to the C-photosensitive drum 50C. The K-developing cartridge 60K includes a K-developing roller 61K, which may supply black toner to the K-photosensitive drum 50K.

The developing cartridge 60 is movable between a position, in which the developing roller 61 being at a contacting position contacts the corresponding photosensitive drum 50, as indicated by solid lines in FIG. 1, and a position, in which the developing roller 61 being at a separated position is separated from the corresponding photosensitive drum 50, as indicated by dash-and-dots lines in FIG. 1.

The photosensitive drum 50 is rotatably supported by a supporting member 55. On the supporting member 55, chargers 52 are arranged. Each charger 52 is provided correspondingly to each of the Y-, M-, C-, K-photosensitive drums 50Y, 50M, 50C, 50K and may electrically charge the corresponding one of the Y-, M-, C-, K-photosensitive drums 50Y, 50M, 50C, 50K. The supporting member 55 is detachably attachable to the casing 10 through an opening (not shown), which may be exposed when a front cover 11 of the casing 10 is open. The supporting member 55 supports the developing cartridge 60 removably.

The conveyer 70 is arranged between the sheet tray 21 and the photosensitive drum 50. The conveyer 70 includes a driving roller 71, a driven roller 72, a conveyer belt 73 being an endless belt, and four (4) transfer rollers 74. The conveyer belt 73 is strained around the driving roller 71 and the driven roller 72, with an upper outer surface thereof contacting the photosensitive drum 50. The transfer rollers 74 are arranged inside the conveyer belt 73 to nip the conveyer belt 73 in cooperation with the Y-, M-, C-, K-photosensitive drums 50Y, 50M, 50C, 50K.

The fuser 80 is arranged at a rearward position with respect to the photosensitive drum 50 and the conveyer 70. The fuser 80 includes a heating roller 81 and a pressing roller 82 arranged to face the heating roller 81 to nip the sheet S at a position between the heating roller 81 and the pressing roller 82. At positions downstream from the fuser 80 in a sheet-conveying direction, arranged are a conveyer roller 15 and an ejection roller 16.

In the image forming device 30, the surface of the photosensitive drum 50 may be charged evenly by the charger 52 and selectively exposed to the light emitted from the exposure device 40. Thereby, electrostatic latent images based on image data may be formed on the surface of the photosensitive drum 50. Meanwhile, the toner in the developing cartridge 60 may be supplied to the surface of the developing roller 61 and may be supplied to the electrostatic latent image formed on the surface of the photosensitive drum 50. Thus, the toner image may be formed on the photosensitive drum 50.

When the sheet S on the conveyer belt 73 passes through the position between the photosensitive drum 50 and the transfer roller 74, the toner image formed on the photosensitive drum 50 may be transferred onto the sheet S. As the sheet S is conveyed to pass through the position between the heating roller 81 and the pressing roller 82, the toner images transferred to the sheet S may be fused to the sheet S. The sheet S ejected from the fuser 80 may be conveyed by the conveyer roller 15 and the ejection roller 16 to rest on an ejection tray 13 formed on an upper face of the casing 10.

The belt cleaning device 90 is arranged between the sheet tray 21 and the conveyer belt 73. The belt cleaning device 90 includes a cleaning roller 91, a collecting roller 92, a scraper blade 93, a storage 94, and a backup roller 95 to nip the conveyer belt 73 together with the cleaning roller 91. The cleaning roller 91 may contact the conveyer belt 73 and remove adhering particles such as residual toner and paper dust from the conveyer belt 73.

In particular, the residues adhered to the conveyer belt 73 may be collected by the cleaning roller 91. The residues transferred to the cleaning roller 91 may be scraped off by the scraper blade 93 and collected in the storage 94.

Figure 2:
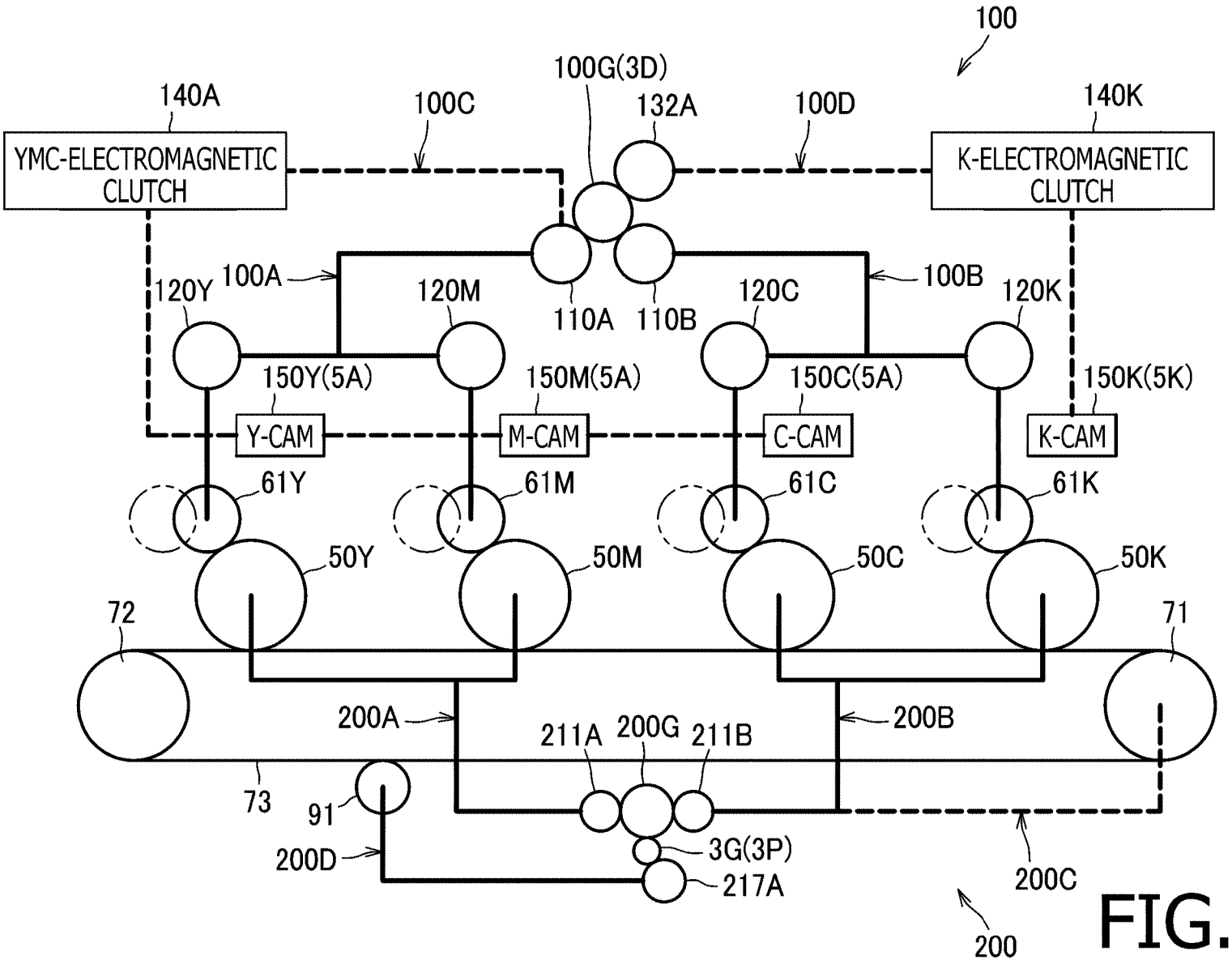
FIG. 2 is a schematic diagram to illustrate driving-force transmission mechanisms in the image forming apparatus according to the embodiment of the present disclosure.

The image forming apparatus 1 further includes, as shown in FIG. 2, a development motor 3D, a process motor 3P, a YMC-moving mechanism 5A, a K-moving mechanism 5K, a first driving-force transmission mechanism 100, and a second driving-force transmission mechanism 200.

The development motor 3D is a driving source, which may drive a development-driving gear 100G to drive the developing roller 61 and cams 150 in the YMC- and K-moving mechanisms 5A, 5K. The cams 150 include a Y-cam 150Y, an M-cam 150M, a C-cam 150C, and a K-cam 150K for the colors of yellow, magenta, cyan, and black. The process motor 3P is a driving source, which may drive a process-driving gear 200G to drive the photosensitive drum 50 and the conveyer belt 73. The process motor 3P is likewise a driving source to drive the cleaning roller 91.

The YMC-moving mechanism 5A may move the Y-developing roller 61Y, the M-developing roller 61M, and the C-developing roller 61C between respective contacting positions and respective separated positions. The YMC-moving mechanism 5A includes the Y-cam 150Y, the M-cam 150M, and the C-cam 150C. The K-moving mechanism 5K may move the K-developing roller K between a contacting position and a separated position and includes the K-cam 150K.

The first driving-force transmission mechanism 100 may transmit the driving force from the development motor 3D to the developing roller 61 and the cam 150. The first driving-force transmission mechanism 100 includes a development-driving gear 100G, a first development-gear train 100A, a second development-gear train 100B, a first control-gear train 100C, and a second control-gear train 100D. In FIG. 2, the first and second development-gear trains 100A, 100B are indicated in thicker solid lines, and the first and second control-gear trains 100C, 100D are indicated in thicker broken lines.

The first development-gear train 100A may transmit the driving force from the development motor 3D to the Y-developing roller 61Y and the M-developing roller 61M. The second development-gear train 100B may transmit the driving force from the development motor 3D to the C-developing roller 61C and the K-developing roller 61K. The first development-gear train 100A and the second development-gear train 100B are provided separately from each other.

The first control-gear train 100C may transmit the driving force from the development motor 3D to the Y-, M-, C-cams 150Y, 150M, 150C. The second control-gear train 100D may transmit the driving force from the development motor 3D to the K-cam 150K. The first control-gear train 100C and the second control-gear train 100D are provided separately from each other. The first control-gear train 100C is branched from the first development-gear train 100A. In other words, the first control-gear 100C is connected to the first development-gear train 100A. On the other hand, the second control-gear 100D is provided separately from the first development-gear train 100A and from the second development-gear train 100B.

The second driving-force transmission mechanism 200 may transmit the driving force from the process motor 3P to the photosensitive drum 50, the conveyer belt 73, and the cleaning roller 91. The second driving-force transmission mechanism 200 includes a process-driving gear 200G, a first process-gear train 200A, a second process-gear train 200B, a belt-gear train 200C, and a cleaning-gear train 200D. In FIG. 2, the first and second process-gear trains 200A, 200B and the cleaning-gear train 200D are indicated in thicker solid lines, and the belt-gear train 200C is indicated in a thicker broken line.

The first process-gear train 200A may transmit the driving force from the process motor 3P to the Y-photosensitive drum 50Y and the M-photosensitive drum 50M. The second process-gear train 200B may transmit the driving force from the process motor 3P to the C-photosensitive drum 50C and the K-photosensitive drum 50K. The first process-gear train 200A and the second process-gear train 200B are provided separately from each other.

The belt-gear train 200C may transmit the driving force from the process motor 3P to the conveyer belt 73. The belt-gear train 200C is branched from the second process-gear train 200B. In other words, the belt-gear train 200C is connected to the second process-gear train 200B. The cleaning-gear train 200D may transmit the driving force from the process motor 3P to the cleaning roller 91. The cleaning-gear train 200D is provided separately from the first process-gear train 200A, the second process-gear train 200B, and the belt-gear train 200C.

Figure 3:
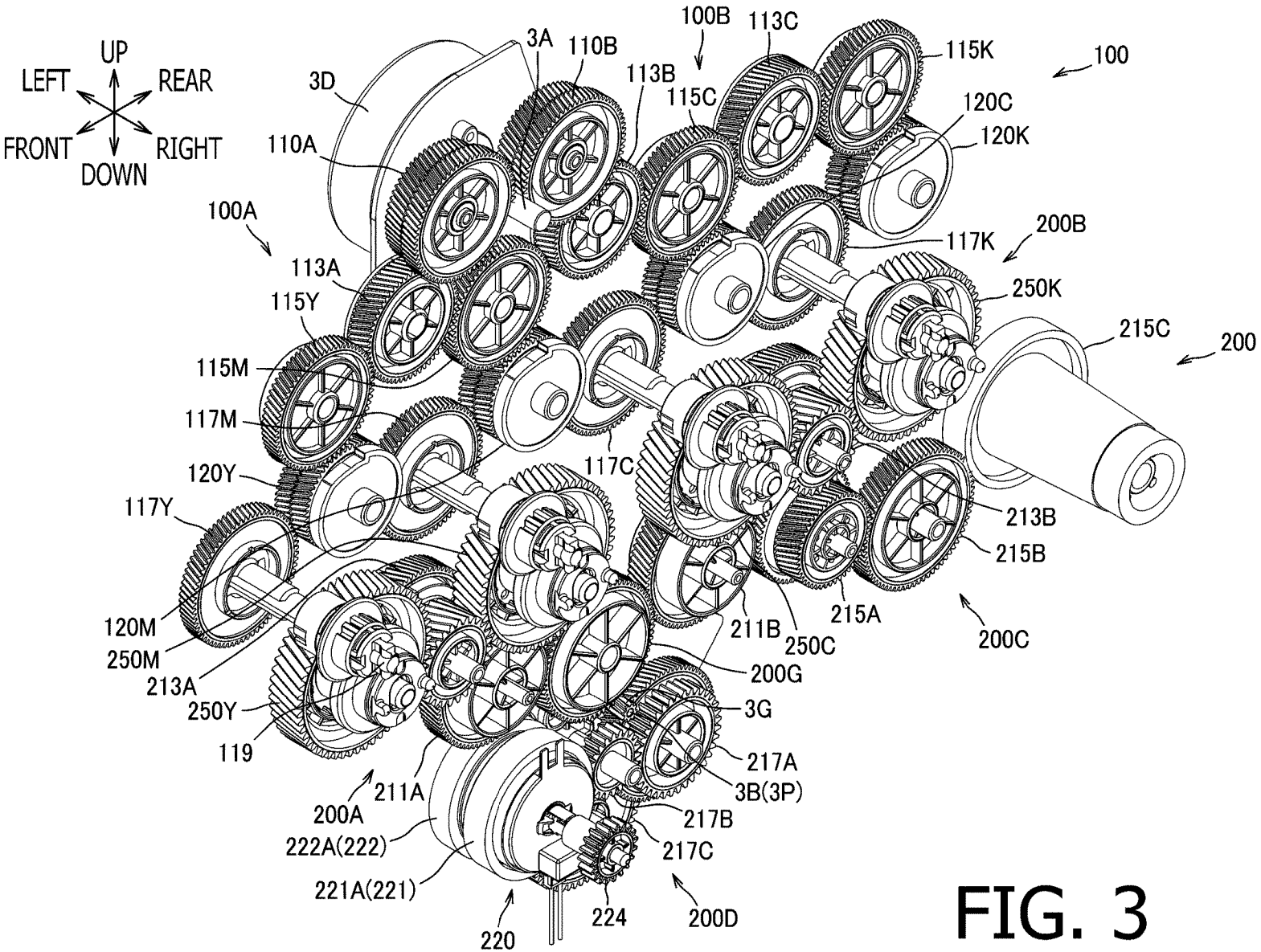
FIG. 3 is a perspective view of a development motor, development-gear trains in a first driving-force transmission mechanism, a process motor, and a second driving-force transmission mechanism in the image forming apparatus according to the embodiment of the present disclosure from an upper-right viewpoint.
Figure 4:
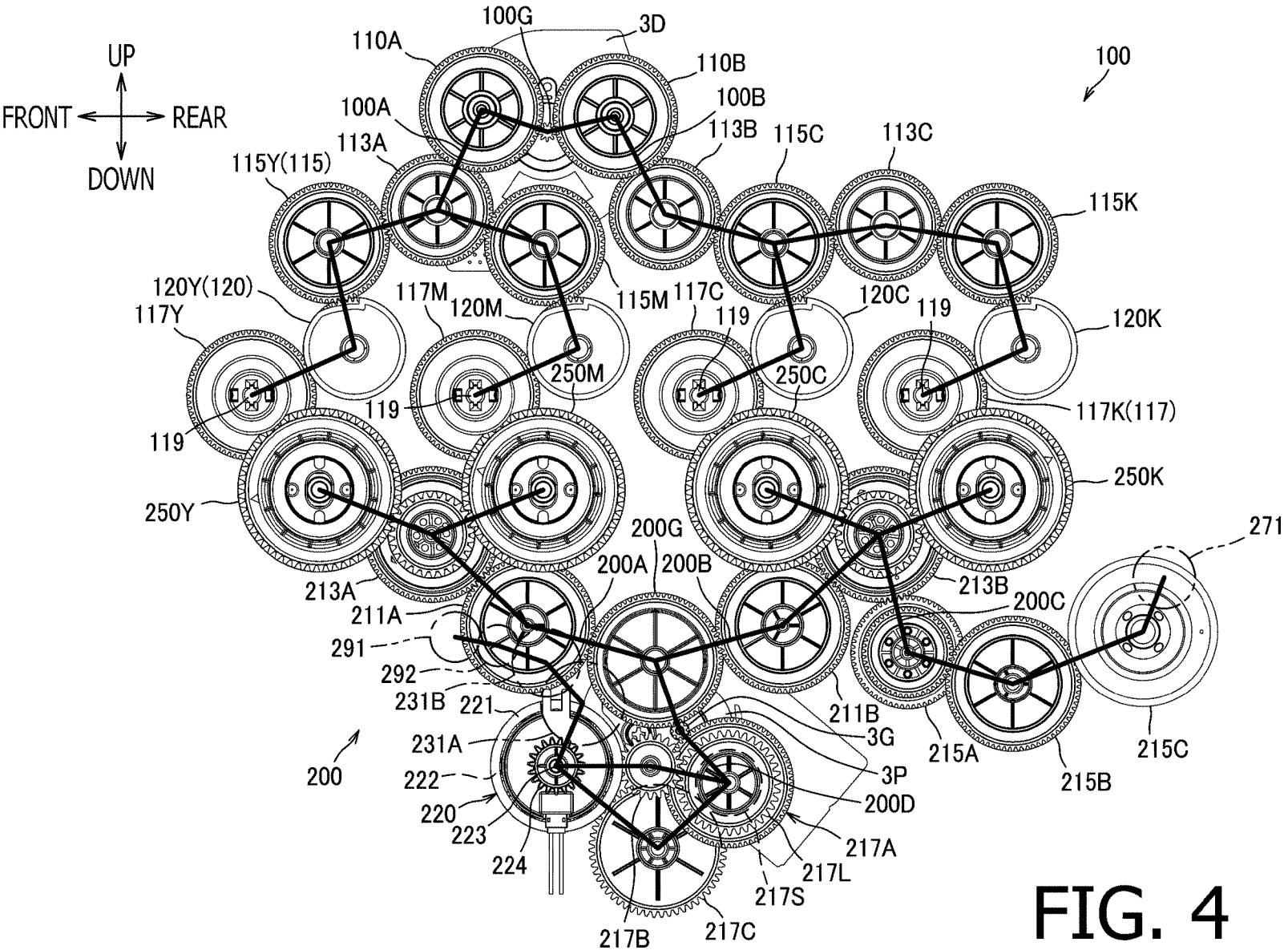
FIG. 4 is a rightward side view of the development motor, the development-gear trains in the first driving-force transmission mechanism, the process motor, and the second driving-force transmission mechanism in the image forming apparatus according to the embodiment of the present disclosure.
Figure 5:
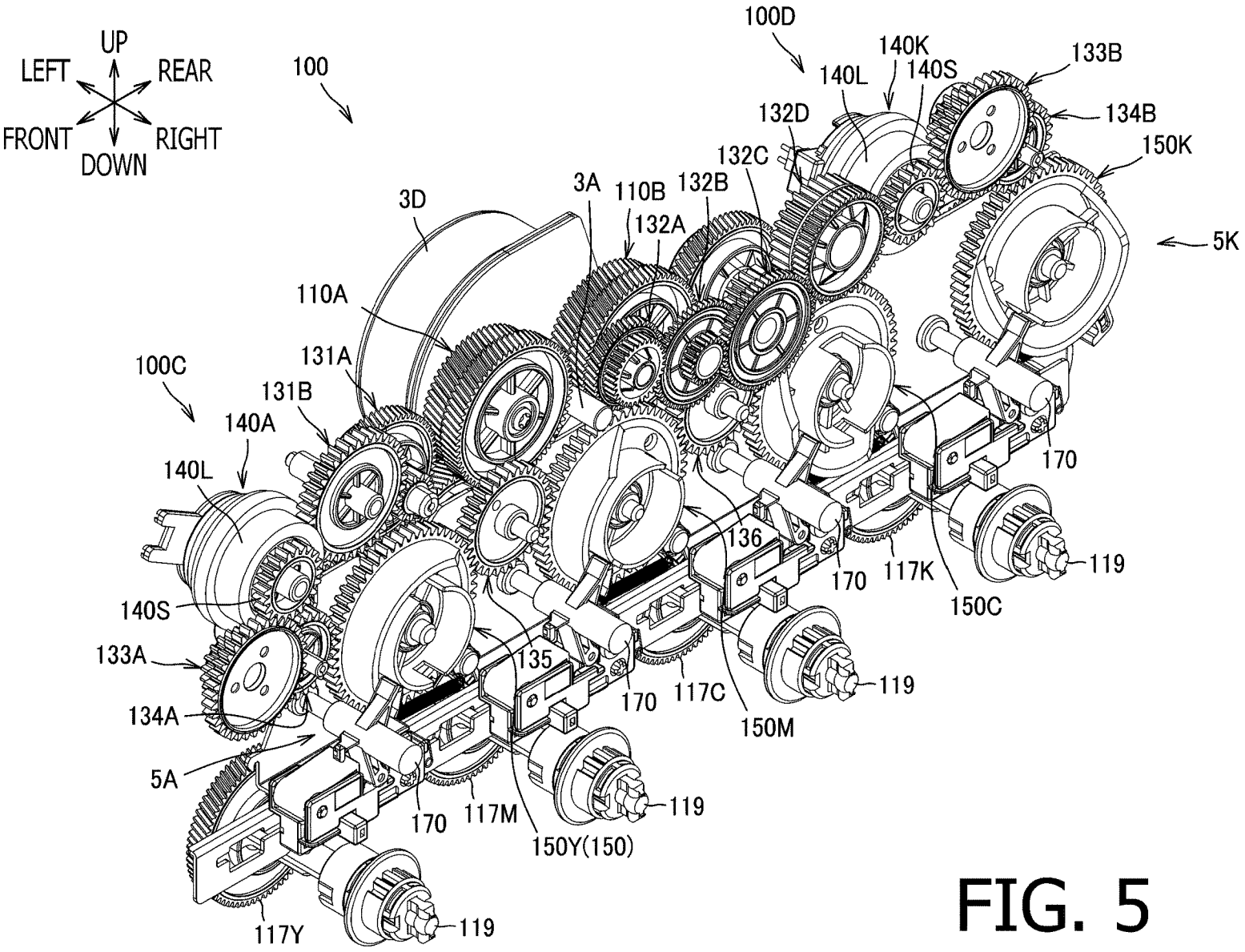
FIG. 5 is a perspective view of the development motor, the first driving-force transmission mechanism, and a moving mechanism in the image forming apparatus according to the embodiment of the present disclosure from an upper-right viewpoint.
Figure 6:
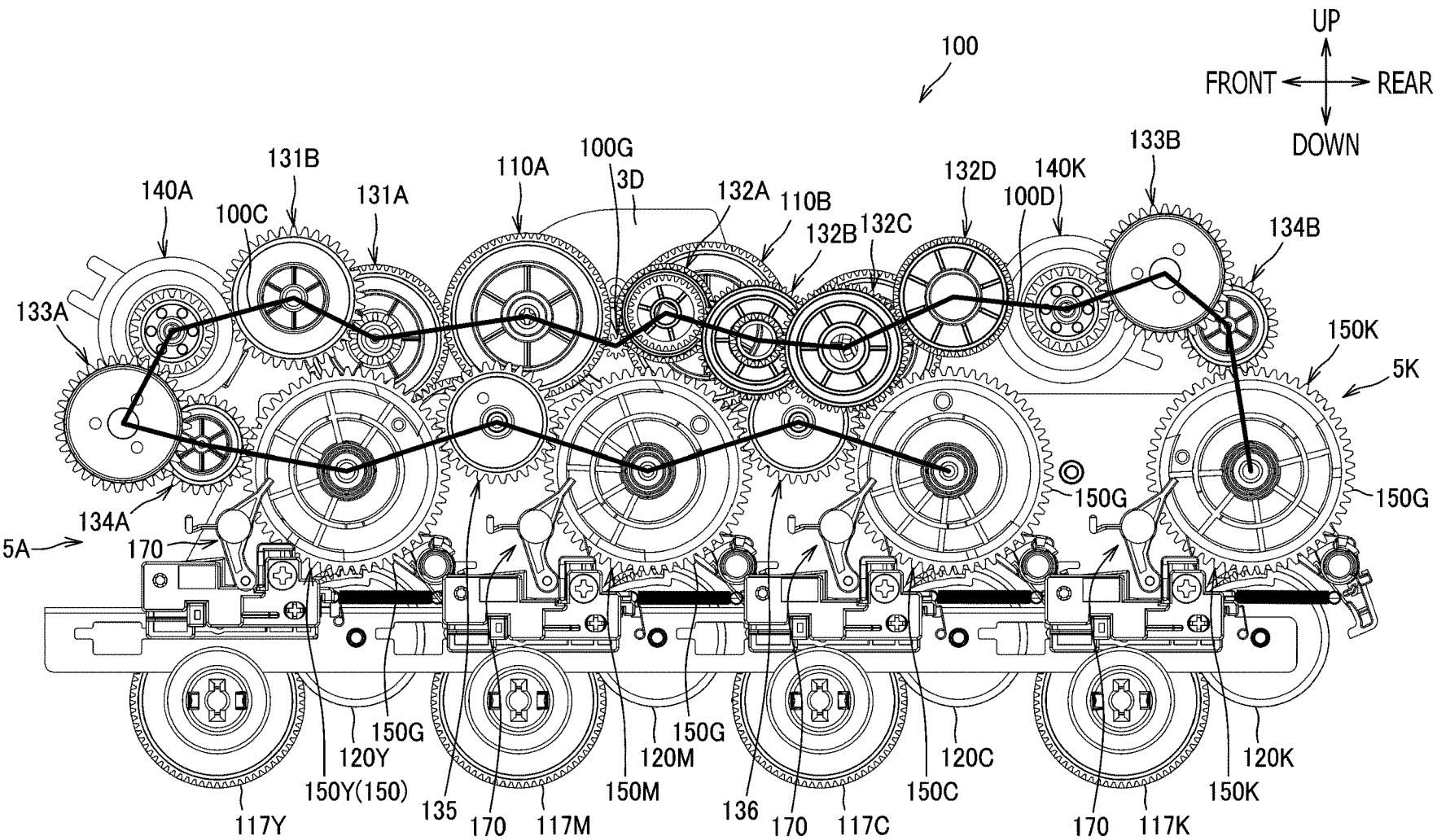
FIG. 6 is a rightward side view of the development motor, the first driving-force transmission mechanism, and the moving mechanism in the image forming apparatus according to the embodiment of the present disclosure.

Next, configurations of the first driving-force transmission mechanism 100 and the YMC- and K-moving mechanisms 5A, 5K will be described in detail. FIGS. 3 and 4 mainly show the first and second development-gear trains 100A, 100B. FIGS. 5 and 6 mainly show the first and second control-gear trains 100C, 100D and the YMC- and K-moving mechanisms 5A, 5K, which are arranged on a rightward side of the first and second development-gear trains 100A, 100B. In FIGS. 4 and 6, intermeshing transmitting flows through the gears in the first and second development-gear trains 100A, 100B and the first and second control-gear trains 100C, 100D are indicated in thicker solid lines.

As shown in FIGS. 3 and 4, the development-driving gear 100G is a gear attached to an output shaft 3A of the development motor 3D. The development-driving gear 100G may rotate integrally with the output shaft 3A by activation of the development motor 3D.

The first development-gear train 100A includes idle gears 110A, 113A, 115Y, 115M, a Y-clutch 120Y, an M-clutch 120M, a Y-coupling gear 117Y, and an M-coupling gear 117M.

The idle gear 110A meshes directly with the development-driving gear 100G and is arranged at a frontward position with respect to the development-driving gear 100G. The idle gear 113A is located at a position below the idle gear 110A and meshes directly with the idle gear 110A.

The idle gear 115Y is arranged at a frontward position with respect to the idle gear 113A and meshes directly with the idle gear 113A. The Y-clutch 120Y is arranged at a position below the idle gear 115Y and meshes directly with the idle gear 115Y The clutch 120, including Y-, M-, C-, K-clutches 120Y, 120M, 120C, 120K for the colors of yellow, magenta, cyan, and black, will be described later.

The Y-coupling gear 117Y may output the driving force from the development motor 3D input through the idle gear 110A to the Y-developing roller 61Y The Y-coupling gear 117Y is arranged at a frontward position with respect to the Y-clutch 120Y and meshes directly with the Y-clutch 120Y To the Y-coupling gear 117Y, the driving force from the development motor 3D may be transmitted through the idle gears 110A, 113A, 115Y, and the Y-clutch 120Y.

The idle gear 115M is arranged at a rearward position with respect to the idle gear 113A and meshes directly with the idle gear 113A. The M-clutch 120M is arranged at a position below the idle gear 115M and meshes directly with the idle gear 115M.

The M-coupling gear 117M may output the driving force from the development motor 3D input through the idle gear 110A to the M-developing roller 61M. The M-coupling gear 117M is arranged at a frontward position with respect to the M-clutch 120M and meshes directly with the M-clutch 120M. To the M-coupling gear 117M, the driving force from the development motor 3D may be transmitted through the idle gears 110A, 113A, 115M, and the M-clutch 120M.

The Y-coupling gear 117Y and the M-coupling gear 117M are located at most downstream positions in the first development-gear train 110A in a transmitting direction to transmit the driving force from the development motor 3D.

The second development-gear train 100B includes idle gears 110B, 113B, 115C, 113C, 115K, the C-clutch 120C, the K-clutch 120K, a C-coupling gear 117C, and a K-coupling gear 117K.

The idle gear 110B meshes directly with the development-driving gear 100G and is arranged at a rearward position with respect to the development-driving gear 100G. The idle gear 113B is located at a position below the idle gear 110B and meshes directly with the idle gear 110B.

The idle gear 115C is arranged at a rearward position with respect to the idle gear 113B and meshes directly with the idle gear 113B. The C-clutch 120C is arranged at a position below the idle gear 115C and meshes directly with the idle gear 115C.

The C-coupling gear 117C may output the driving force from the development motor 3D input through the idle gear 110B to the C-developing roller 61C. The C-coupling gear 117C is arranged at a frontward position with respect to the C-clutch 120C and meshes directly with the C-clutch 120C. To the C-coupling gear 117C, the driving force from the development motor 3D may be transmitted through the idle gears 110B, 113B, 115C, and the C-clutch 120C.

The idle gear 113C is arranged at a rearward position with respect to the idle gear 115C and meshes directly with the idle gear 115C. The idle gear 115K is arranged at a rearward position with respect to the idle gear 113C and meshes directly with the idle gear 113C. The K-clutch 120K is arranged at a position below the idle gear 115K and meshes directly with the idle gear 115K.

The K-coupling gear 117K may output the driving force from the development motor 3D input through the idle gear 110B to the K-developing roller 61K. The K-coupling gear 117K is arranged at a frontward position with respect to the K-clutch 120K and meshes directly with the K-clutch 120K. To the K-coupling gear 117K, the driving force from the development motor 3D may be transmitted through the idle gears 110B, 113B, 115C, 113C, 115K, and the K-clutch 120K.

The C-coupling gear 117C and the K-coupling gear 117K are located at most downstream positions in the second development-gear train 110B in a transmitting direction to transmit the driving force from the development motor 3D.

The coupling gear 117 includes a coupling shaft 119, and the coupling gear 117 and the coupling shaft 119 rotate integrally. The coupling shaft 119 is movable in a direction of an axis thereof in cooperation with opening/closing motions of the front cover 11 (see FIG. 1). The coupling shaft 119 may engage with a coupling (not shown) in the developing cartridge 60 when the front cover 11 is closed. While the coupling shaft 119 is engaged with the coupling in the developing cartridge 60, and when the coupling gear 117 rotates, the driving force from the developing motor 3D may be transmitted to the developing roller 61, causing the developing roller 61 to rotate.

A quantity of the gears intervening between the idle gear 110A and the Y-coupling gear 117Y in the first development-gear train 100A is three (3): the idle gears 113A, 115Y, and the Y-clutch 120Y A quantity of the gears intervening between the idle gear 110A and the M-coupling gear 117M in the first development-gear train 100A is three (3): the idle gears 113A, 115M, and the M-clutch 120M. Moreover, a quantity of the gears intervening between the idle gear 110B and the C-coupling gear 117C in the second development-gear train 100B is three (3): the idle gears 113B, 115C, and the C-clutch 120C.

In other words, the quantity of the gears intervening between the idle gear 110A and the Y-coupling gear 117Y, the quantity of the gears intervening between the idle gear 110A and the M-coupling gear 117M, and the quantity of the gears intervening between the idle gear 110B and the C-coupling gear 117C are equal.

Meanwhile, a quantity of the gears intervening between the idle gear 110B and the K-coupling gear 117K in the second development-gear train 110B is five (5): the idle gears 113B, 115C, 113C, 115K, and the K-clutch 120K. In other words, in the second development-gear train 110B, the quantity of the gears intervening between the idle gear 110B and the K-coupling gear 117K, which may be used for monochrome printing, is greater than the quantity of the gears intervening between the idle gear 110B and the C-coupling gear 117C, which may be used for multicolor printing. Moreover, the quantity of the gears intervening between the idle gear 110B and the K-coupling gear 117K is greater than the quantities of the gears intervening between the idle gear 110A and each of the Y-coupling gear 117Y, the M-coupling gear 117M, the C-coupling gear 117C, which may be used for monochrome printing.

As shown in FIGS. 5 and 6, the first control-gear train 100C includes idle gears 131A, 131B, a YMC-electromagnetic clutch 140A, idle gears 133A, 134A, the Y-cam 150Y including a gear portion 150G, an idle gear 135, the M-cam 150M including a gear portion 150G, an idle gear 136, and the C-cam 150C including a gear portion 150G.

The YMC-electromagnetic clutch 140A includes a larger-diameter gear 140L and a smaller-diameter gear 140S. The larger-diameter gear 140L meshes directly with the idle gear 131B, and the smaller-diameter gear 140S meshes directly with the idle gear 133A.

To the Y-cam 150Y, the driving force from the development motor 3D may be transmitted through the idle gears 110A, 131A, 131B, the YMC-electromagnetic clutch 140A, and the idle gears 133A, 134A. To the M-cam 150M, the driving force may be transmitted through the Y-cam 150Y and the idle gear 135. To the C-cam 150C, the driving force may be transmitted through the M-cam 150M and the idle gear 136.

The second control-gear train 100D includes idle gears 132A, 132B, 132C, 132D, a K-electromagnetic clutch 140K, idle gears 133B, 134B, and the K-cam 150K including a gear portion 150G.

The K-electromagnetic clutch 140K includes a larger-diameter gear 140L and a smaller-diameter gear 140S. The larger-diameter gear 140L meshes directly with the idle gear 132D, and the smaller-diameter gear 140S meshes directly with the idle gear 133B. To the K-cam 150K, the driving force from the development motor 3D may be transmitted through the idle gears 132A-132D, the K-electromagnetic clutch 140K, and the idle gears 133B, 134B.

The YMC-electromagnetic clutch 140A and the K-electromagnetic clutch 140K may switch transmission and disconnection of the driving force to switch states of the Y-, M-, C-cams 150Y, 150M, 150C and the K-cam 150K, respectively, between rotating and stationary. In particular, when the electromagnetic clutch 140 is activated by being powered on, the larger-diameter gear 140L and the smaller-diameter gear 140S may integrally rotate. Thereby, the driving force may be transmitted to the cam(s) 150 corresponding to the electromagnetic clutch 140, and the cam(s) 150 may rotate. On the other hand, when the electromagnetic clutch 140 is deactivated by being powered off, the larger-diameter gear 140L may idle with respect to the smaller-diameter gear 140S, which bears the load from the gears downstream in the transmission flow causing the smaller-diameter gear 140S to stay stationary without rotating. Therefore, the driving force may be discontinued between the larger-diameter gear 140L and the smaller-diameter gear 140S, and the cam(s) 150 may stay stationary. Activation or deactivation of the YMC- and K-electromagnetic clutches 140A, 140K may be controlled individually by the controller 2.

The YMC-moving mechanism 5A includes the Y-, M-, C-cams 150Y, 150M, 150C, and a plurality of cam followers 170, each of which corresponds to one of the Y-, M-, C-cams 150Y, 150M, 150C. The K-moving mechanism 5K includes the K-cam 150K and a cam follower 170 corresponding to the K-cam 150K.

Figure 7A:
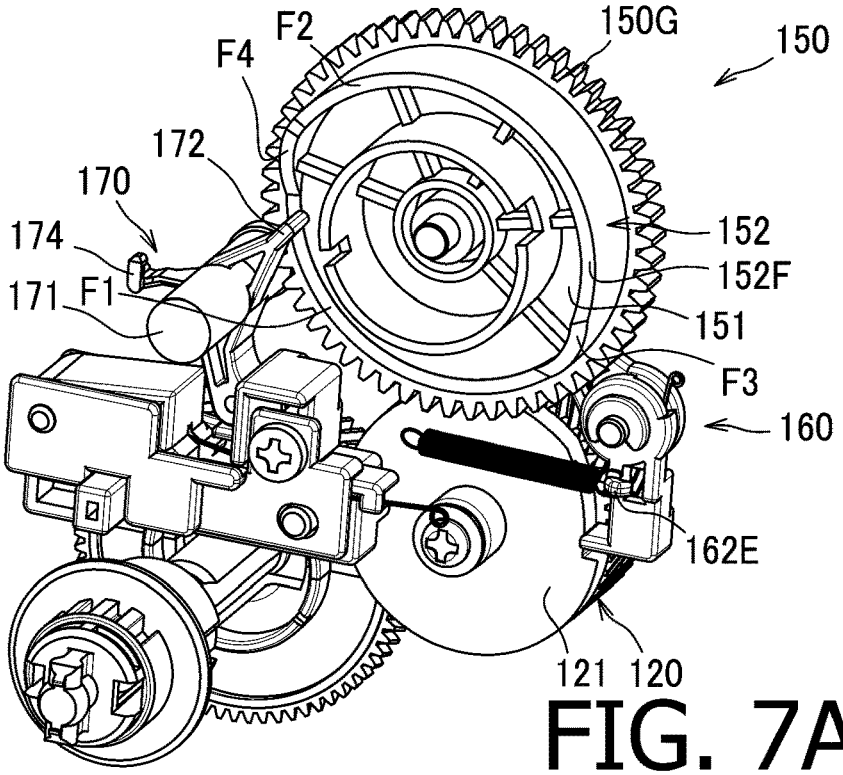
FIGS. 7A and 7B are a perspective view and a side view, respectively, of a cam, a cam follower, a clutch, and a restrictive member when a developing roller is at a contacting position in the image forming apparatus according to the embodiment of the present disclosure.
Figure 7B:
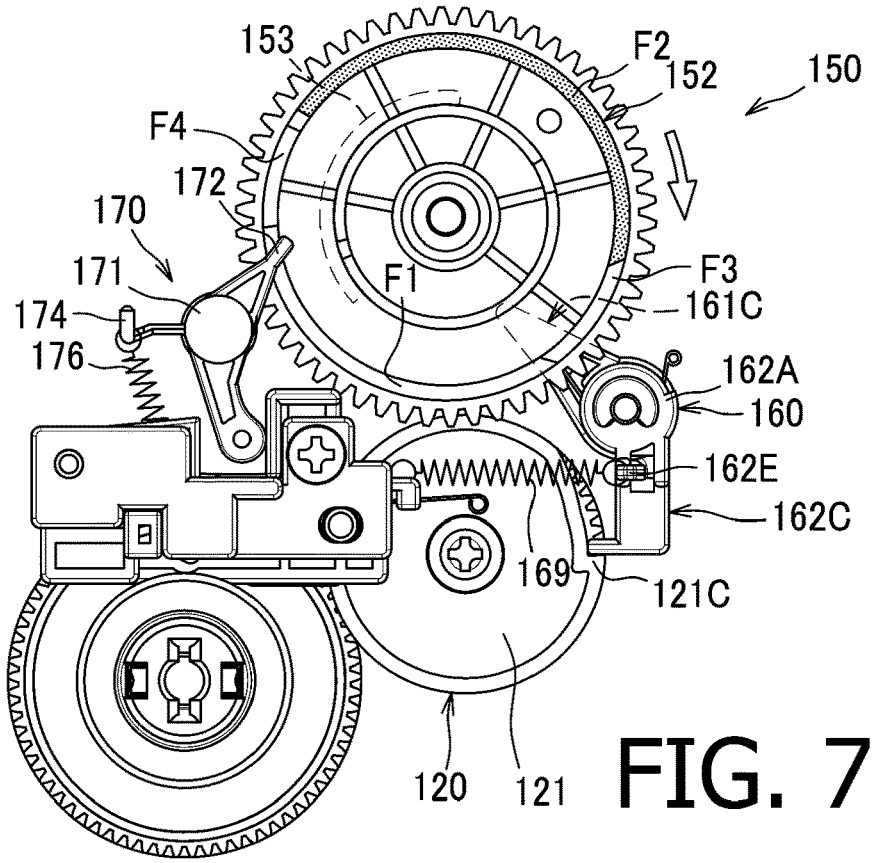

The cam 150 may move the corresponding developing roller 61 between the contacting position and the separated position by rotating. As shown in FIGS. 7A-7B, the cam 150 includes a disk portion 151, the gear portion 150G formed on an outer circumference of the disk portion 151, a first cam portion 152, and a second cam portion 153.

The first cam portion 152 may move the developing roller 61 between the contacting position and the separated position and protrudes from a sideward face of the disk portion 151 in an axial direction of the developing roller 61. The first cam portion 152 includes a cam face 152F at an end thereof in the axial direction. The cam face 152F includes a first retainer face F1, a second retainer face F2, a first guide face F3, and a second guide face F4.

The first retainer face F1 may retain the cam follower 170 at a standby position, which will be described further below. The second retainer face F2 may retain the cam follower 170 at a protrusive position, which will be described further below. The second retainer face F2 is indicated by dot-hatching in the first cam portion 152 shown in, for example, FIG. 7B. The first guide face F3 connects the first retainer face F1 and the second retainer face F2 and inclines with respect to the first retainer face F1. The second guide face F4 connects the second retainer face F2 and the first retainer face F1 and inclines with respect to the first retainer face F1.

The second cam portion 153 works in cooperation with a restrictive member 160, which will be described further below, to switch conditions of the clutch 120. The second cam portion 153 extends in an arc in a view along the axial direction of the developing roller 61 and protrudes from the other sideward face of the disk portion 151 opposite to the sideward face, on which the first cam portion 152 is formed.

The cam follower 170 includes a slidable shaft 171, a contact portion 172, and a spring hook 174. The slidable shaft 171 is slidably supported by a supporting shaft 179 (see FIG. 8B), which is fixed to the casing 10, to slide in the axial direction of the developing roller 61. Therefore, the cam follower 170 is slidable in the axial direction.

The contact portion 172 extends from the slidable shaft 171 and may contact the cam face 152F of the first cam portion 152. The cam follower 170 is slidably movable between the protrusive position (see FIG. 8B), at which the contact portion 172 may contact the second retainer face F2 and locate the developing roller 61 at the separated position, and the standby position (see FIG. 8A), at which the contact portion 172 may contact the first retainer face F1 and locate the developing roller 61 at the contacting position.

Referring back to FIGS. 7A-7B, the spring hook 174 is a part, to which an end of a spring 176 is hooked, and extends from the slidable shaft 171 in a direction different from the contact portion 172. The spring 176 may be a contractive spring, and the other end of the spring 176 is hooked to another spring hook (not shown), which a part of the casing 10 located at a lower-leftward position with respect to the spring hook 174. The spring 176 may urge the cam follower 170 in a direction from the protrusive position toward the standby position.

Figures 8A, 8B:
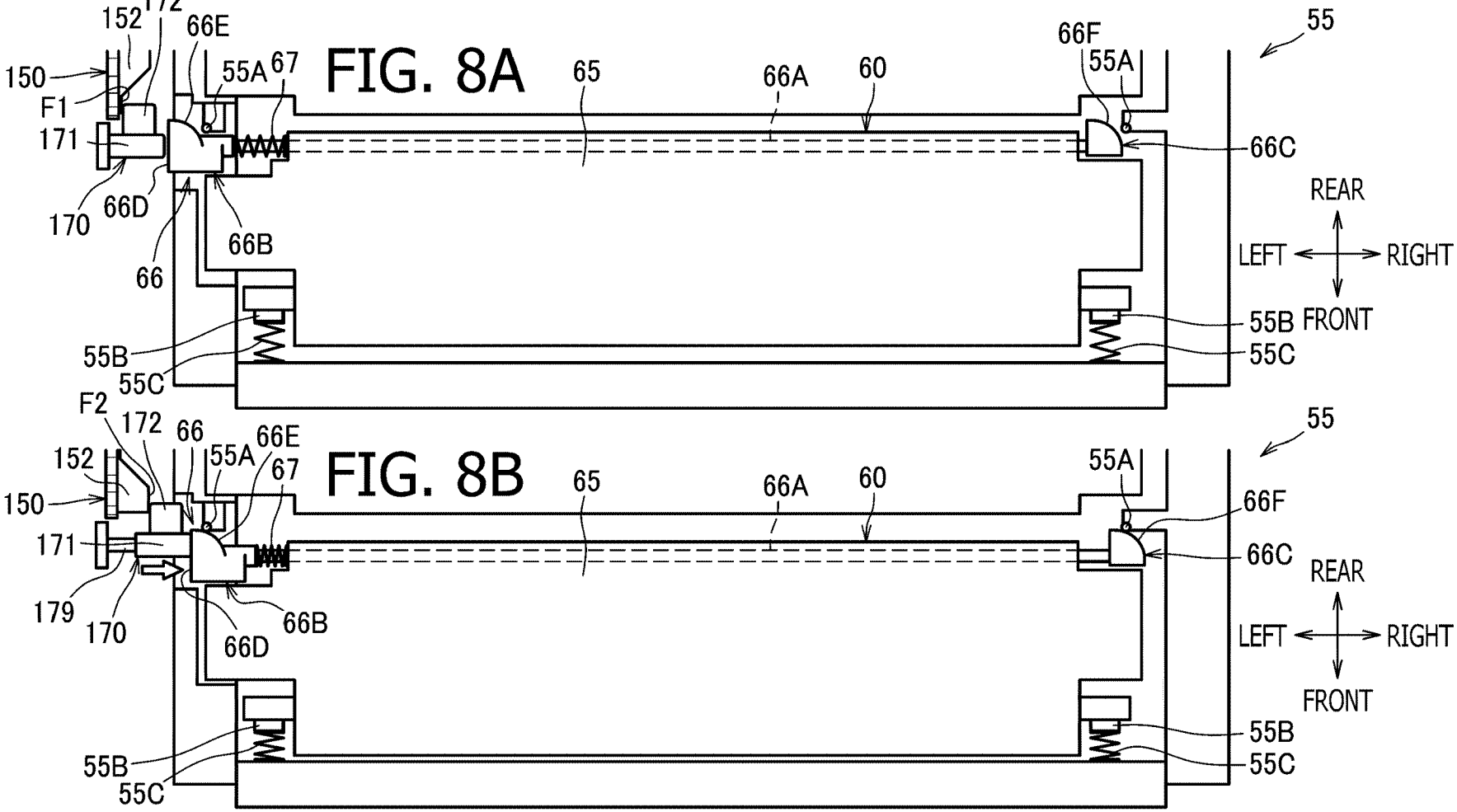
FIGS. 8A and 8B are upper-side plan views of a developing cartridge and periphery thereof in the image forming apparatus according to the embodiment of the present disclosure.

As shown in FIGS. 8A-8B, the developing cartridge 60 is supported by the supporting member 55 movably in the front-rear direction. The supporting member 55 includes passive-contact portions 55A and pressing members 55B. Each passive-contact portion 55A is a part of the supporting member 55, at which a slider member 66 may contact, and includes a roller, which is rotatable about a shaft extending in the vertical direction. The slider member 66 will be described further below. Each pressing member 55B is urged rearward by a spring 55C. When the developing cartridge 60 is attached to the supporting member 55, the pressing members 55B may press the developing cartridge 60 to place the developing roller 61 at the contacting position, at which the developing roller 61 contacts the photosensitive drum 50.

The developing cartridge 60 includes a case 65 to contain toner and the slider member 66. The slider member 66 is slidable to move with respect to the case 65 in the axial direction of the developing roller 61. The slider member 66 may be pressed by the cam follower 170 to slidably move in the axial direction. The slider member 66 includes a shaft 66A, a first contact member 66B, and a second contact member 66C. The shaft 66A is slidably supported by the case 65. The first contact member 66B is fixed to one end, e.g., a leftward end, of the shaft 66A, and the second contact member 66C is fixed to the other end, e.g., a rightward end, of the shaft 66A.

The first contact member 66B includes a pressing face 66D and an oblique face 66E, which inclines with respect to the axial direction. The second contact member 66C includes an oblique face 66F, which inclines similarly to the oblique face 66E. The pressing face 66D is a face to be pressed by the cam follower 170. The oblique faces 66E, 66F may, when the slider member 66 is pressed by the cam follower 170 in the axial direction, contact the passive-contact portions 55A and urge the developing cartridge 60 in a direction intersecting orthogonally with the axial direction to move the developing cartridge 60 to the separated position, at which the developing roller 61 is separated from the photosensitive drum 50. At a position between the first contact member 66B and the case 65, arranged is a spring 67, which urges the slider member 66 leftward.

Figure 9A:
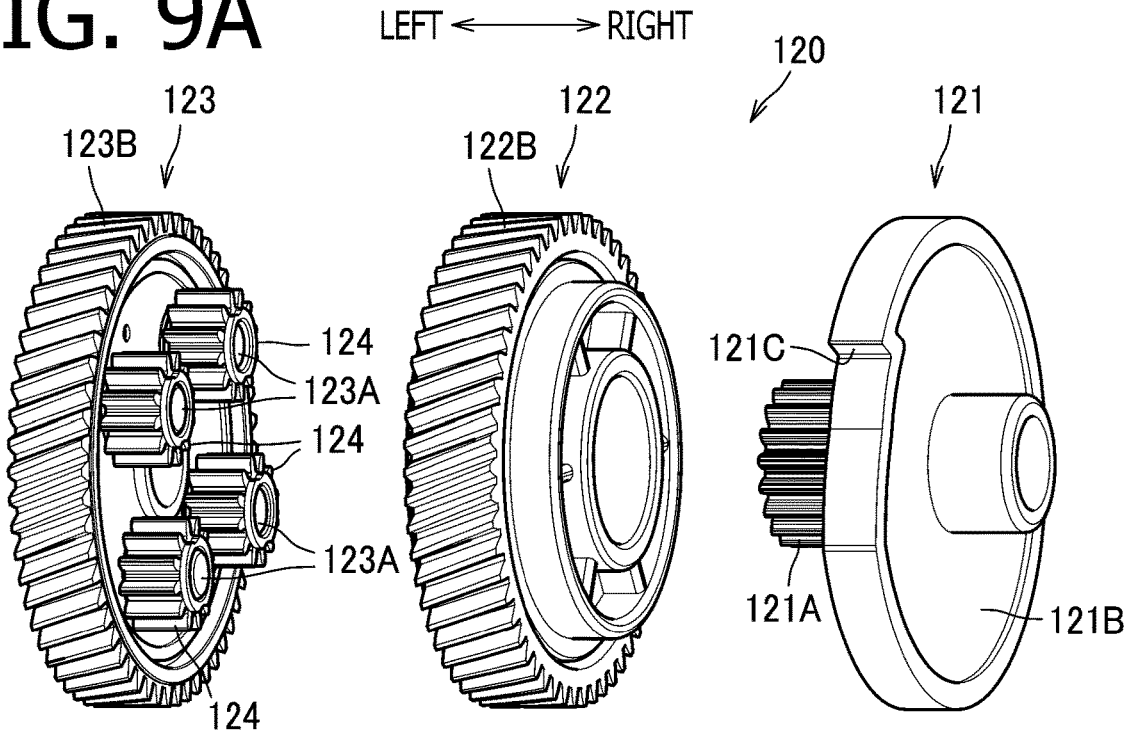
FIGS. 9A and 9B are exploded views of the clutch in the image forming apparatus according to the embodiment of the present disclosure, viewed from a side of a sun gear and a side of a carrier, respectively.
Figure 9B:
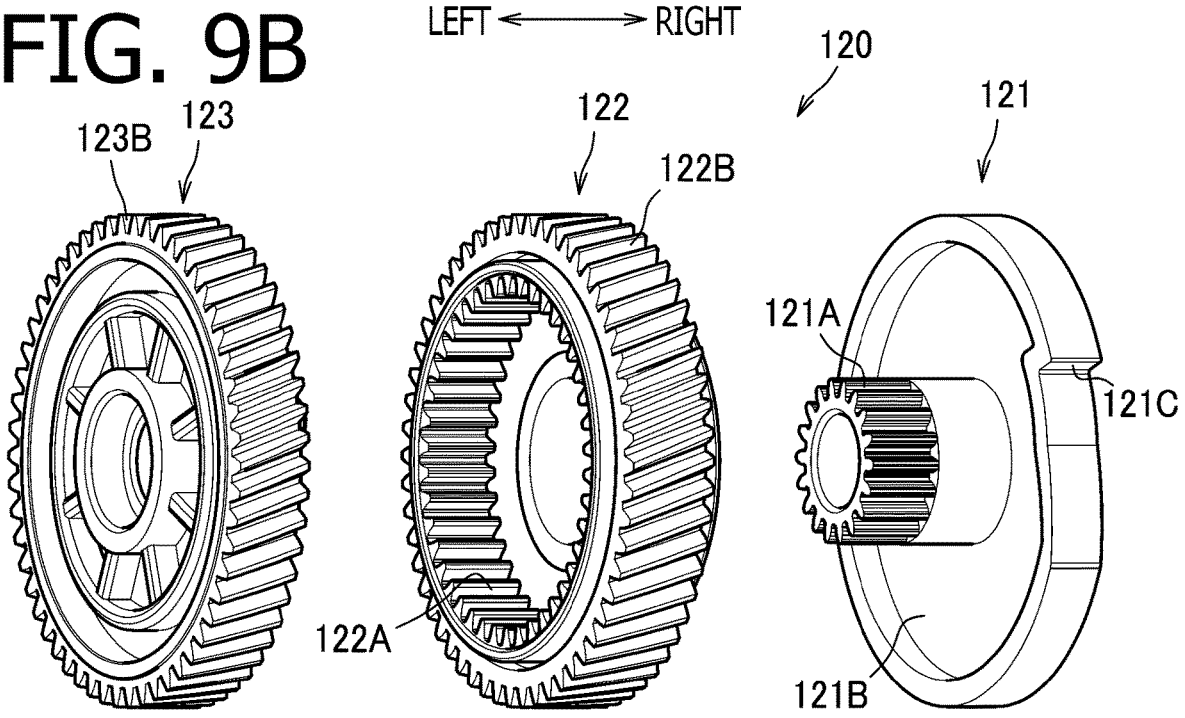

As shown in FIGS. 9A-9B, the clutch 120, including the Y-clutch 120Y, the M-clutch 120M, the C-clutch 120C, and the K-clutch 120K, is switchable between an engaging state, in which the clutch 120 engages transmission of the driving force input through the idle gears 110A, 110B (see FIG. 4) to the developing roller 61, and a disengaging state, in which the clutch 120 disengages transmission of the driving force input through the idle gears 110A, 110B to the developing roller 61. The clutch 120 includes a planetary gear assembly. For example, the clutch 120 may include a sun gear 121, which is rotatable about an axis, a ring gear 122, a carrier 123, and planetary gears 124 supported by the carrier 123.

The sun gear 121 includes a gear portion 121A, a disc portion 121B rotatable integrally with the gear portion 121A, and a claw portion 121C arranged on an outer circumference of the disc portion 121. The ring gear 122 includes an inner gear 122A arranged on an inner circumferential surface and an input gear 122B arranged on an outer circumferential surface. The input gear 122B meshes directly with the idle gear 115 (see FIG. 4).

The carrier 123 includes four (4) shaft portions 123A, which support the planetary gears 124 rotatably, and an output gear 123B, which is arranged on an outer circumferential surface of the carrier 123. The output gear 123B meshes directly with the coupling gear 117 (see FIG. 4). The planetary gears 124 include four (4) planetary gears 124, each of which is supported by one of the shaft portions 123A in the carrier 123. The planetary gears 124 mesh with the gear portion 121A of the sun gear 121 and with the inner gear 122A in the ring gear 122.

When the sun gear 121 is restrained from rotating, the clutch 120 is in the engaging state, in which the driving force input through the input gear 122B may be transmitted to the output gear 123B. On the other hand, when the sun gear 121 is allowed to rotate, the clutch 120 is in the disengaging state, in which the driving force input through the input gear 122B is not transmittable to the output gear 123B. When the clutch 120 is in the disengaging state, and the output gear 123B is under load, and when the driving force is input through the input gear 122B, the output gear 123B does not rotate, and the sun gear 121 idles.

As shown in FIGS. 7A-7B, the first driving-force transmission mechanism 100 includes the restrictive member 160. The restrictive member 160 includes four (4) restrictive members 160, each of which corresponds to one of the Y-, M-, C-, and K-clutches 120Y, 120M, 120C, 120K. Each restrictive member 160 includes a rotation-supporting portion 162A, a first arm 161C extending from the rotation-supporting portion 161A, and a second arm 162C extending from the rotation-supporting portion 162A in a direction different from the first arm 161C. The rotation-supporting portion 162A is rotatably supported by a supporting shaft, which is not shown but is arranged on the casing 10.

The second arm 162C extends in an arrangement such that a tip end thereof points at an outer circumferential surface of the sun gear 121. The second arm 162C has the spring hook 162E, to which an end of a spring 169 is hooked. The spring 169 may be a contractive spring, and the other end of the spring 169 is hooked to a spring hook, which is not shown, formed at a frontward position with respect to the spring hook 162E. Thus, the spring 169 may urge the restrictive member 160 to rotate from a separated position to an engaged position, e.g., clockwise in FIGS. 7A-7B. The separated position and the engaged position will be described further below.

Figure 10A:
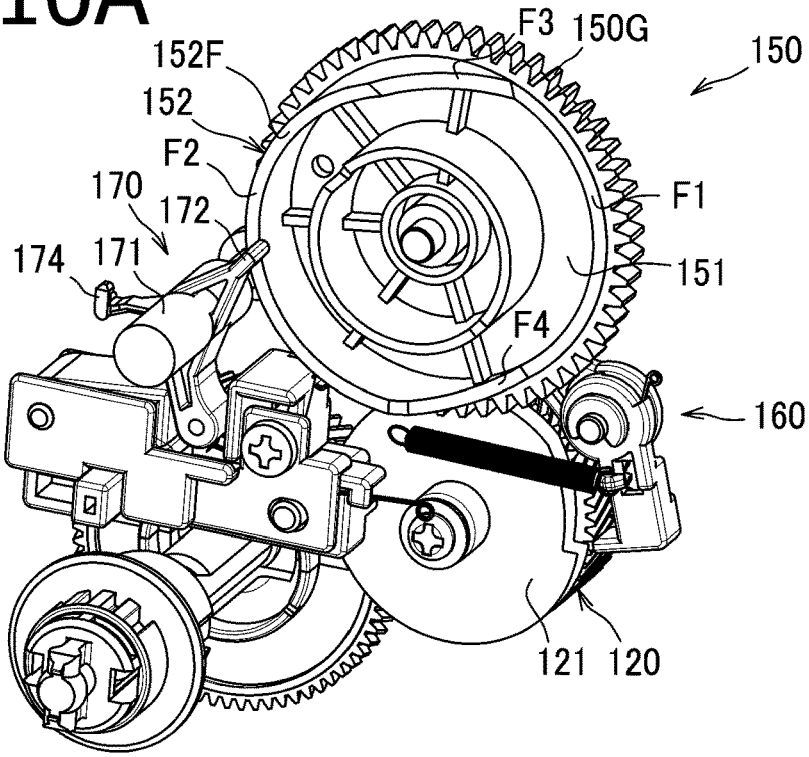
FIGS. 10A and 10B are a perspective view and a side view, respectively, of the cam, the cam follower, the clutch, and the restrictive member when the developing roller is at a separated position in the image forming apparatus according to the embodiment of the present disclosure.
Figure 10B:
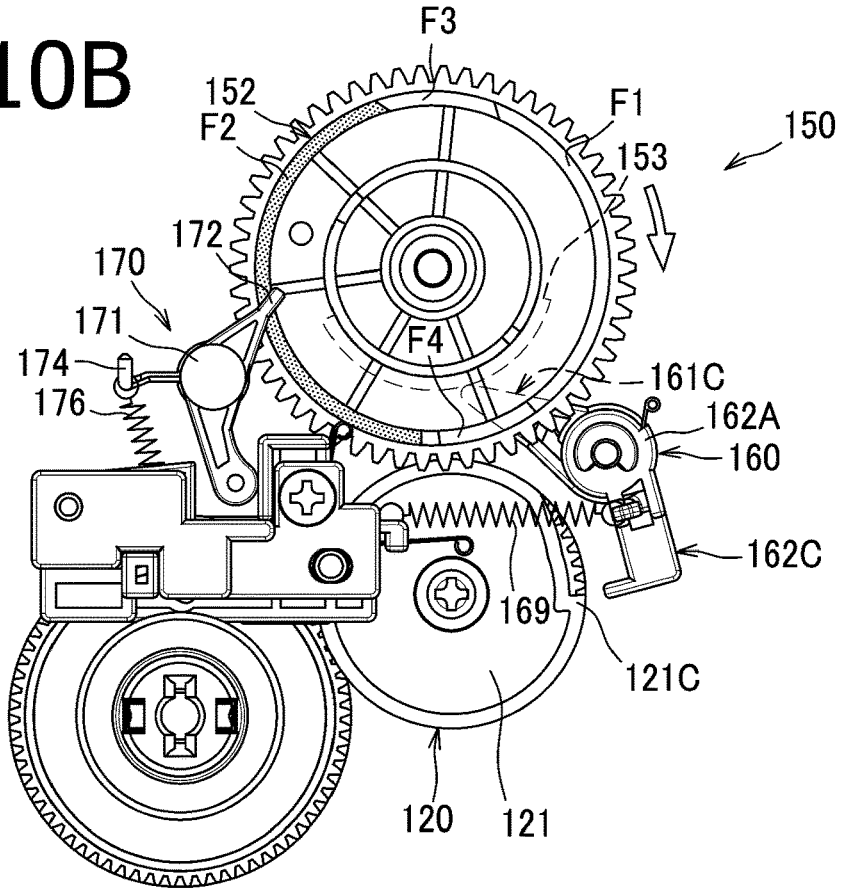

The restrictive member 160 is movable to swing between the engaged position, at which a tip end of the second arm 162C engages with the claw portion 121C in the sun gear 121 to restrict the sun gear 121 from rotating, and the separated position, at which the tip end of the second arm 162C is separated from the claw portion 121C to allow the sun gear 121 to rotate (see FIGS. 10A-10B).

Meanwhile, the restrictive member 160 may contact the second cam portion 153 at a tip end of the first arm 161C. When the tip end of the first arm 161C is separated from the second cam portion 153, the restrictive member 160 is placed at the engaged position by the urging force of the spring 169, and when the tip end of the first arm 161C contacts the second cam portion 153 (see FIGS. 10A-10B), the restrictive member 160 may swing against the urging force of the spring 169 and may be located at the separated position.

The second cam portion 153 is formed in an arrangement such that the second cam portion 153 may locate the restrictive member 160 at the engaged position to place the clutch 120 in the engaging state before the developing roller 61 moving from the separated position to the contacting positions contacts the photosensitive drum 50 and locate the restrictive member 160 at the separated position to place the clutch 120 in the disengaging state after the developing roller 61 moving from the contacting position to the separated position separates from the photosensitive drum 50. Therefore, the developing roller 61 may rotate when the developing roller 61 is at the contacting position and stays stationary when the developing roller 61 is at the separated position.

The controller 2 may control overall actions in the image forming apparatus 1. The controller 2 includes a CPU, a ROM, a RAM, and an input/output device, which are not shown. The controller 2 may execute predetermined programs to process operations. For example, the controller 2 may control activation and deactivation of the YMC-clutch 140A and the K-clutch 140K to control the contacting and separating motions of the developing roller 61 with respect to the photosensitive drum 50.

In the following paragraphs, exemplary processes to be executed by the controller 2 will be described. When the image forming apparatus 1 is standing by for a print job, the developing roller, 61 including the Y-, M-, C-, K-developing rollers 61Y, 61M, 61C, 61K, is located at the separated position, and the cam follower 170 is at the protrusive position, as shown in FIGS. 10A-10B, at which the contact portion 172 contacts the second retainer face F2 of the cam 150.

When a print job for forming an image is received, the controller 2 may drive the development motor 3D and activate the YMC-electromagnetic clutch 140A and/or the K-electromagnetic clutch 140K, depending on the colors of the toners to be used for forming the image, to rotate the cam 150 clockwise in FIGS. 10A-10B. Thereby, the contact portion 172 in the cam follower 170 may be guided from the second retainer face F2 to the second guide face F4, slide on the second guide face F4, and contact the first retainer face F1, as shown in FIGS. 7A-7B. Thus, the cam follower 170 may be slidably moved by the urging force of the spring 176 from the protrusive position shown in FIG. 8B to the standby position shown in FIG. 8A, causing the developing roller 61 to move from the separated position to the contacting position. When the developing roller 61 is located at the contacting position, the controller 2 may deactivate the YMC-electromagnetic clutch 140A and/or the K-electromagnetic clutch 140K to stop rotation of the cam 150.

When the developing roller 61 finishes developing the image, the controller 2 may activate the YMC-electromagnetic clutch 140A and/or the K-electromagnetic clutch 140K to rotate the cam 150 clockwise in FIGS. 7A-7B again. Thereby, the contact portion 172 may be guided from the first retainer face F1 to the first guide face F3, slide on the first guide face F3, and contact the second retainer face F2, as shown in FIGS. 10A-10B. Accordingly, the cam follower 170 may slidably move to the standby position shown in FIG. 8A to the protrusive position shown in FIG. 8B, causing the developing roller 61 to move from the contacting position to the separated position. When the developing roller 61 is located at the separated position, the controller 2 may deactivate the YMC-electromagnetic clutch 140A and/or the K-electromagnetic clutch 140K to stop rotation of the cam 150.

Next, the second driving-force transmission mechanism 200 will be described in detail. As shown in FIGS. 3 and 4, the process-driving gear 200G meshes directly with the motor gear 3G. The motor gear 3G is a gear attached to an output shaft 3B of the process motor 3P.

The first process-gear train 200A includes idle gears 211A, 213A, a Y-drum gear 250Y, and an M-drum gear 250M.

The idle gear 211A meshes directly with the process-driving gear 200G and is arranged at a frontward position with respect to the process-driving gear 200G. The idle gear 213A is arranged at an upper-frontward position with respect to the idle gear 211A and meshes directly with the idle gear 211A.

The Y-drum gear 250Y rotates coaxially and integrally with the Y-photosensitive drum 50Y The Y-drum gear 250Y is arranged at a frontward position with respect to the idle gear 213A and meshes directly with the idle gear 213A. The M-drum gear 250M rotates coaxially and integrally with the M-photosensitive drum 50M. The M-drum gear 250M is arranged at a rearward position with respect to the idle gear 213A and meshes directly with the idle gear 213A. To the Y-drum gear 250Y and the M-drum gear 250M, the driving force from the process motor 3P may be transmitted through the process-driving gear 200G and the idle gears 211A, 213A.

The second process-gear train 200B includes idle gears 211B, 213B, a C-drum gear 250C, and a K-drum gear 250K. The idle gear 211B meshes directly with the process-driving gear 200G and is arranged at a rearward position with respect to the process-driving gear 200G. The idle gear 213B is arranged at an upper-rearward position with respect to the idle gear 211B and meshes directly with the idle gear 211B.

The C-drum gear 250C rotates coaxially and integrally with the C-photosensitive drum 50C. The C-drum gear 250C is arranged at a frontward position with respect to the idle gear 213B and meshes directly with the idle gear 213B. The K-drum gear 250K rotates coaxially and integrally with the K-photosensitive drum 50K. The K-drum gear 250K is arranged at a rearward position with respect to the idle gear 213B and meshes directly with the idle gear 213B. To the C-drum gear 250C and the K-drum gear 250K, the driving force from the process motor 3P may be transmitted through the process-driving gear 200G and the idle gears 211B, 213B.

The belt-gear train 200C includes idle gears 215A, 215B, 215C, and a driving-roller gear 271.

The idle gear 215A meshes directly with the idle gear 213B, which forms a part of the second process-gear train 200B, and is arranged at a position below the idle gear 213B. The idle gear 213B forms a part of the second process-gear train 200B, which is, between the first process-gear train 200A and the second process-gear train 200B, closer to the belt-gear train 200C. In other words, the second process-gear train 200B is closer to the belt-gear train 200C than the first process-gear train 200A.

The idle gear 215B is arranged at a rearward position with respect to the idle gear 215A and meshes directly with the idle gear 215A. The idle gear 215C is arranged at a rearward position with respect to the idle gear 215B and meshes directly with the idle gear 215B.

The driving-roller gear 271 rotates coaxially and integrally with the driving roller 71, which drives the conveyer belt 73, and meshes directly with the idle gear 215C. To the driving-roller gear 271, the driving force from the process motor 3P may be transmitted through the process-driving gear 200G and the idle gears 211B, 213B, 215A, 215B, 215C.

The cleaning-gear train 200D includes idle gears 217A, 217B, 217C, a clutch mechanism 220, idle gears 231A, 231B, a collecting-roller gear 292, and a cleaning-roller gear 291.

The idle gear 217A meshes directly with the motor gear 3G and is arranged at a position below the motor gear 3G. Moreover, the idle gear 217A is located at a position substantially opposite to the process-driving gear 200G across the motor gear 3G. The idle gear 217A includes a larger-diameter gear 217L and a smaller-diameter gear 217S.

The idle gear 217B is arranged at a frontward position with respect to the idle gear 217A and meshes directly with the larger-diameter gear 217L of the idle gear 217A. The idle gear 217C is arranged at a lower-frontward position with respect to the idle gear 217A and meshes directly with the smaller-diameter gear 217S of the idle gear 217A. A diameter of the idle gear 217B is smaller than a diameter of the idle gear 217C. As the idle gear 217A rotates, the idle gear 217B rotates at a faster rotating velocity than the idle gear 217C.

The clutch mechanism 220 is arranged at a frontward position with respect to the idle gears 217B, 217C. The clutch mechanism 220 includes an electromagnetic clutch 221, a one-way clutch 222, an output shaft 223, and an output gear 224 attached to the output shaft 223. The electromagnetic clutch 221 and the one-way clutch 222 are arranged coaxially. The electromagnetic clutch 221 includes an input gear 221A, which meshes directly with the idle gear 217B. The one-way clutch 222 includes an input gear 222A, which meshes directly with the idle gear 217C.

The clutch mechanism 220 may, when the electromagnetic clutch 221 is powered and activated, transmit the driving force input through the input gear 221A in the electromagnetic clutch 221 to the output shaft 223 but may not transmit the driving force input through the input gear 222A in the one-way clutch 222 to the output shaft 223. On the other hand, when the electromagnetic clutch 221 is not powered or deactivated, the clutch mechanism 220 may not transmit the driving force input through the input gear 221A in the electromagnetic clutch 221 to the output shaft 223 but may transmit the driving force input through the input gear 222A in the one-way clutch 222 to the output shaft 223.

The idle gear 231A is arranged a position above the output gear 224 and meshes directly with the output gear 224. The output gear 224, the idle gears 231A, 231B, the collecting-roller gear 292, and the cleaning-roller gear 291 are arranged rightward, e.g., a nearer side in FIG. 4, with respect to the first and second process-gear trains 220A, 220B. The idle gear 231B is arranged at an upper-frontward position with respect to the idle gear 231A and meshes directly with the idle gear 231A.

The collecting-roller gear 292 rotates coaxially and integrally with the collecting roller 92. The collecting-roller gear 292 is located at a frontward position with respect to the idle gear 231B and meshes directly with the idle gear 231B. The cleaning-roller gear 291 rotates coaxially and integrally with the cleaning roller 91. The cleaning-roller gear 291 is located at a frontward position with respect to the collecting-roller gear 292 and meshes directly with the collecting-roller gear 292.

To the cleaning-roller gear 291, when the electromagnetic clutch 221 is activated, the driving force from the process motor 3P may be transmitted through the idle gears 217A, 217B, the electromagnetic clutch 221 in the clutch mechanism 220, the idle gears 231A, 231B, and the collecting-roller gear 292. On the other hand, when the electromagnetic clutch 221 is deactivated, the driving force from the process motor 3P may be transmitted to the cleaning-roller gear 291 through the idle gears 217A, 217C, the one-way clutch 222 in the clutch mechanism 220, the idle gears 231A, 231B, and the collecting-roller gear 292.

In other words, the driving force from the process motor 3P may be transmitted to the cleaning-roller gear 291 through the idle gear 217B and the electromagnetic clutch 221 when the electromagnetic clutch 221 is powered on and may be transmitted to the cleaning-roller gear 291 through the idle gear 217C and the one-way clutch 222 when the electromagnetic clutch 221 is powered off. The cleaning-roller gear 291, and the cleaning roller 91, may rotate in a faster rotation velocity when the electromagnetic clutch 221 is powered on than when the electromagnetic clutch 221 is powered off.

According to the embodiment described above, the first development-gear train 100A may transmit the driving force from the development motor 3D to two (2) of the four (4) developing rollers 61, e.g., the Y-developing roller 61Y and the M-developing roller 61M. Meanwhile, the second development-gear train 100B may transmit the driving force from the development motor 3D to the other two (2) of the developing rollers 61, e.g., the C-developing roller 61C and the K-developing roller 61K. Therefore, compared to, for example, a configuration, in which one of the two (2) development-gear trains may transmit the driving force to three (3) developing rollers among four (4) developing rollers, the torque to act on the idle gears 110A, 110B may be restrained from increasing. Moreover, the first and second process-gear trains 200A, 200B may transmit the driving force from the process motor 3P in the same manner; therefore, the torque to act on the idle gears 211A, 211B may be restrained from increasing. Due to the arrangement of these gear trains, without increasing the thicknesses of the idle tears 110A, 110B, 211A, 211B, deformation of teeth in the idle gears 110A, 110B, 211A, 211B may be restrained.

Moreover, intensities of the torque to act on the first development-gear train 100A and the torque to act on the second development-gear train 100B may be substantially equalized; therefore, some or at least a part of the gears may be commonly prepared for the first development-gear train 100A and the second development-gear train 100B. For example, commonly designed gears may be used as the idle gear 11A and the idle gear 110B, commonly designed gears may be used as the idle gear 113A and the idle gear 113B, and/or commonly designed gears may be used as the idle gears 115Y, 115M, 115C, 115K. Similarly, intensities of the torque to act on the first process-gear train 200A and the torque to act on the second process-gear train 200B may be substantially equalized; therefore, some or at least a part of the gears may be commonly prepared for the first process-gear train 200A and the second process-gear train 200B. For example, commonly designed gears may be used as the idle gear 211A and the idle gear 211B, and/or commonly designed gears may be used as the idle gear 213A and the idle gear 213B.

Thus, volumes and manufacturing costs for the first and second driving-force transmission mechanisms 100, 200 to transmit the driving forces from the development motor 3D and the process motor 3P to the developing roller 61 and the photosensitive drum 50 may be reduced. Moreover, by using the commonly designed parts, deviation or irregularities in rotations of the gears in the first and second development-gear trains 100A, 100B and in the first and second process-gear trains 200A, 200B may be restrained; therefore, the developing roller 61 and the photosensitive drum 50 may be driven reliably.

Moreover, the first development-gear train 100A includes the Y- and M-clutches 120Y, 120M, and the second development-gear train 100B includes the C- and K-clutches 120C, 120K. Therefore, with the clutch 120, which is switchable between the engaging state and the disengaging state, the developing roller 61 may be controlled to rotate or stop rotating. Therefore, for example, operation modes may be switched between a multicolor printing mode, in which the Y-, M-, C-, K-developing rollers 61Y, 61M, 61C, 61K may be used to form a multicolor image on the sheet S, and a monochrome printing mode, in which a single developing roller 61K, e.g., the K-developing roller 61K, alone may be used to form a monochrome image on the sheet S.

Moreover, the image forming apparatus 1 includes the belt-gear train 200, which is branched from the process-gear train 200B, to transmit the driving force from the process motor 3P to the conveyer belt 73. Therefore, the photosensitive drum 50, including the Y-, M-, C-, K-photosensitive drums 50Y, 50M, 50C, 50K, and the conveyer belt 73, which is arranged to contact the Y-, M-, C-, K-photosensitive drums 50Y, 50M, 50C, 50K, may be driven commonly by the process motor 3P. Therefore, the photosensitive drum 50 and the conveyer belt 73 may be driven mutually reliably.

Moreover, the driving force to the belt-gear train 200C is input through the idle gear 215A, which meshes with the idle gear 213B forming a part of the second process-gear train 200B while the process-gear train 200B is located closer to the belt-gear train 200C than the first process-gear train 200A. Therefore, a quantity of the gears connected to the belt-gear train 200C may be reduced, and a volume and a manufacturing cost for the second driving-force transmission mechanism 200 may be reduced. Moreover, while the quantity of the gears is reduced, for example, intensities of friction forces that may affect shafts in the gears, intensities of friction forces that may be produced between the gears and the shafts, and intensities of friction forces that may be produced between teeth in the intermeshing gears, may be reduced. Therefore, an amount of loss of the driving force may be reduced.

Moreover, the image forming apparatus 1 has the cleaning-gear train 200D, which includes the idle gear 217A to mesh directly with the motor gear 3G, to transmit the driving force from the process motor 3P to the cleaning roller 91. Therefore, the photosensitive drum 50, the conveyer belt 73, and the cleaning roller 91 may be driven commonly by the process motor 3P. Accordingly, the photosensitive drum 50, the conveyer belt 73, and the cleaning roller 91 may be driven synchronously reliably. Moreover, the cleaning-gear train 200D is drivable separately from the first and second process-gear trains 200A, 200B; therefore, the intensity of the torque to act on the first and second process-gear trains 200A, 200B may be restrained from increasing.

Moreover, the quantity of the gears intervening between the idle gear 110A and the Y-coupling gear 117Y, the quantity of the gears intervening between the idle gear 110A and the M-coupling gear 117M, and the quantity of the gears intervening between the idle gear 110B and the C-coupling gear 117C are equal. Therefore, deviation or irregularities in rotations among the gears to transmit the driving force to the Y-, M-, C-developing rollers 61Y, 61M, 61C may be restrained, and the Y-, M-, C-developing rollers 61Y, 61M, 61C may be driven stably. In this regard, irregular image formation, in which, for example, toner images formed through the Y-, M-, C-developing rollers 61Y, 61M, 61C are deviated from one another on the sheet S, may be restrained.

Moreover, the quantity of the gears intervening between the idle gear 110B and the K-coupling gear 117K is greater than the quantities of the gears intervening between the idle gear 110A and each of the Y-coupling gear 117Y, the M-coupling gear 117M, and than the quantity of the gears intervening between the idle gear 110B and the C-coupling gear 117C. Therefore, compared to a case, in which the quantity of the gears intervening between the idle gear 110B and the K-coupling gear 117K is equal to the quantities of the gears intervening between the idle gear 110A and each of the Y-coupling gear 117Y, the M-coupling gear 117M and to the quantity of the gears intervening between the idle gear 110B and the C-coupling gear 117C, the development-driving gear 100G and the development motor 3D may be arranged more freely, and a degree of freedom for designing the image forming apparatus 1 may be increased.

Moreover, the process-driving gear 200G meshes directly with the motor gear 3G. Therefore, compared to a case, in which another gear(s) intervenes between the process-driving gear 200G and the motor gear 3G attached to the output shaft 3B of the process motor 3P, a quantity of the gears may be reduced. Therefore, a volume and a manufacturing cost for the second driving-force transmission mechanism 200 may be reduced. Moreover, with the reduced quantity of gears, an amount of loss of the driving force may be reduced.

Moreover, the development-driving gear 100G is the gear attached to the output shaft 3A of the development motor 3D. Therefore, compared to a case, in which another gear(s) intervenes between the development-driving gear 100G and a gear attached to the output shaft 3A of the development motor 3D, a quantity of the gears may be reduced. Therefore, a volume and a manufacturing cost for the first driving-force transmission mechanism 100 may be reduced. Moreover, with the reduced quantity of gears, an amount of loss of the driving force may be reduced.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first control-gear train 100C for multicolor printing, which may transmit the driving force from the development motor 3D to the YMC-moving mechanism 5A, may not necessarily be branched from the first development-gear train 100A, or the second control-gear train 100D for monochrome printing, which may transmit the driving force from the development motor 3D to the K-moving mechanism 5K, may not necessarily be provided separately from the first development-gear train 100A or the second development-gear train 100B; but the first control-gear train for multicolor printing may be provided separately from the first development-gear train and the second development-gear train, and the second control-gear train for monochrome printing may be branched from the first development-gear train. For another example, both the first control-gear train and the second control-gear train may be provided separately from the first development-gear train and the second development-gear train.

For another example, the idle gear 215A in the belt-gear train 200C may not necessarily mesh directly with the idle gear 213B in the second process-gear train 200B to connect the belt-gear train 200C to the second process-gear train 200B, but the idle gear in the belt-gear train may mesh directly with one of the gears in the first process-gear train 100A. In other words, the gear in the belt-gear train may mesh directly with any one of the gears in the first process-gear train or the second process-gear train.

Figure 11:
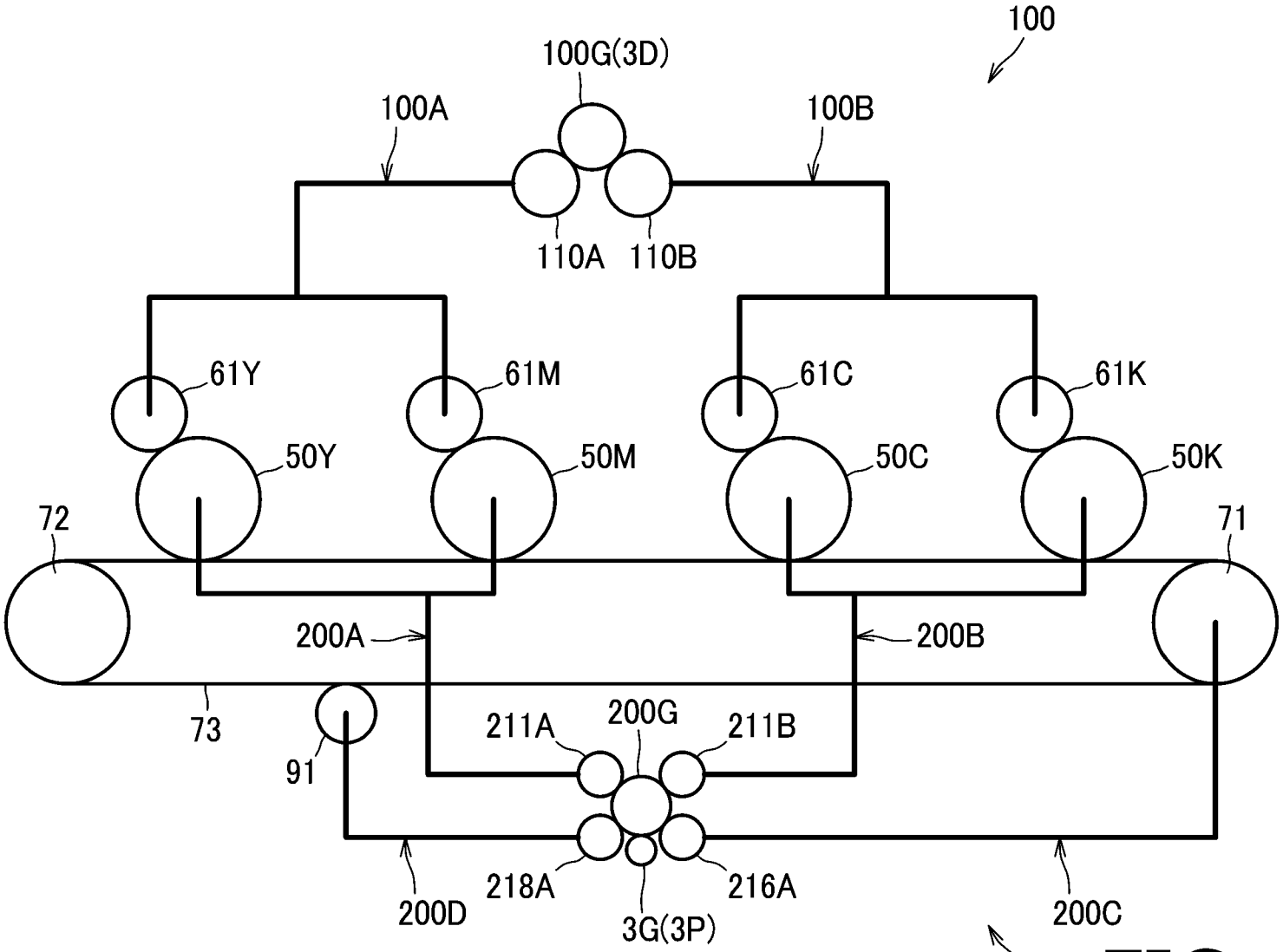
FIG. 11 is a schematic diagram to illustrate a first modified example of the driving-force transmission mechanisms in the image forming apparatus according to the embodiment of the present disclosure.

For another example, the belt-gear train 200C may not necessarily be branched from the second process-gear train 200B. As shown in FIG. 11, the belt-gear train 200 may be provided separately from the first process-gear train 200A, the second process-gear train 200B, and the cleaning-gear train 200D and may have an idle gear 216A to mesh directly with the process-driving gear 200G.

In this arrangement, the plurality of photosensitive drums 50Y, 50M, 50C, 50K and the conveyer belt 73 arranged to contact the plurality of photosensitive drums 50Y, 50M, 50C, 50K may as well be driven by the common process motor 3P. Therefore, the photosensitive drums 50Y, 50M, 50C, 50K and the conveyer belt 73 may be driven synchronously and reliably. Moreover, with the belt-gear train 200C separated from the first and second process-gear trains 200A, 200B, the intensities of the torque to act on the first and second process-gear trains 200A, 200B may be restrained from increasing.

For another example, the idle gear 217A in the cleaning-gear train 200D may not necessarily mesh directly with the motor gear 3G to transmit the driving force from the process motor 3P input directly from the motor gear 3G. For example, as shown in FIG. 11, the cleaning-gear train 200D may have an idle gear 218A to mesh directly with the process-driving gear 200G so that the driving force from the process motor 3P may be input to the cleaning-gear train 200D through the motor gear 3G and the process-driving gear 200G.

In this arrangement, the plurality of photosensitive drums 50Y, 50M, 50C, 50K, the conveyer belt 73, and the cleaning roller 91 may as well be driven by the common process motor 3P. Therefore, the photosensitive drums 50Y, 50M, 50C, 50K, the conveyer belt 73, and the cleaning roller 91 may be driven synchronously and reliably. Moreover, with the cleaning-gear train 200D separated from the first and second process-gear trains 200A, 200B, the intensities of the torque to act on the first and second process-gear trains 200A, 200B may be restrained from increasing.

For another example, the cleaning-gear train 200D may not necessarily be provided separately from the first process-gear train 200A and the second process-gear train 200B but may be connected to and branched from one of the first process-gear train 200A and the second process-gear train 200B.

Figure 12:
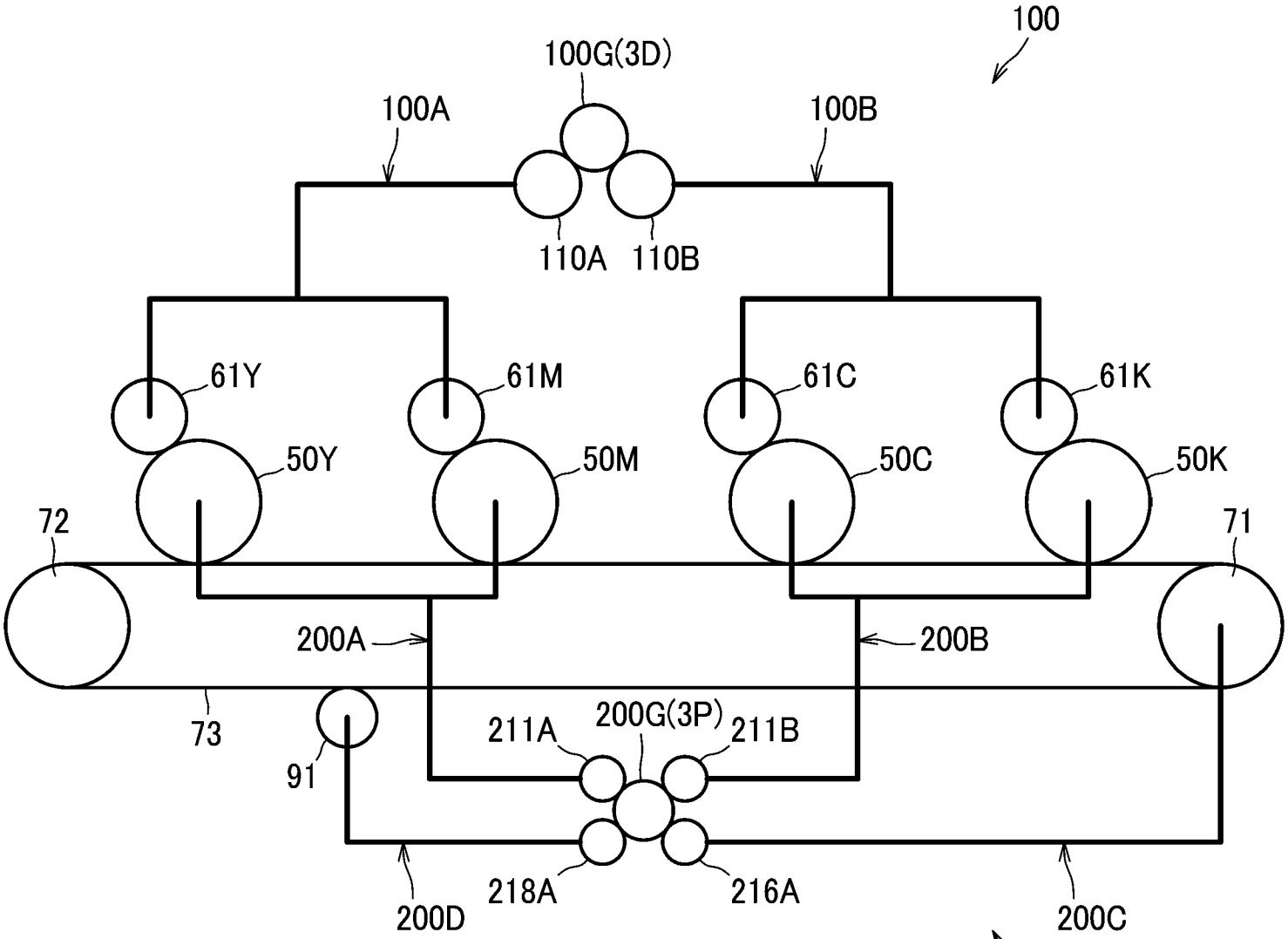
FIG. 12 is a schematic diagram to illustrate a second modified example of the driving-force transmission mechanisms in the image forming apparatus according to the embodiment of the present disclosure.

For another example, the process-driving gear 200G may not necessarily mesh directly with the motor gear 3G. As shown in FIG. 12, the process-driving gear 200G may be attached to the output shaft 3B of the process motor 3P. In this arrangement, a quantity of the gears may be reduced, and a volume and a manufacturing cost of the second driving-force transmission mechanism 200 may be reduced. Moreover, with the reduced quantity of gears, an amount of loss of the driving force may be reduced.

For another example, the process-driving gear 200G may mesh with the motor gear 3G attached to the output shaft 3B of the process motor 3P through one or more intervening idle gear(s).

For another example, the development-driving gear 100G may not necessarily be the gear attached to the output shaft 3A of the development motor 3D but may be arranged to mesh directly with a gear, which is attached to the output shaft 3A of the development motor 3D, or may mesh indirectly with the gear attached to the output shaft 3A of the development motor 3D through one or more intervening idle gear(s).

For another example, the quantity of the gears intervening between the idle gear 110B and the K-coupling gear 117K, which may be used for monochrome printing, in the second development-gear train 100B may not necessarily be greater than the quantity of the gears intervening between the idle gear 110B and the C-coupling gear 117C, which may be used for multicolor printing, but the quantities of the gears intervening between the idle gear 110B and the K-coupling gear 117K and the gears intervening between the idle gear 110B and the C-coupling gear 117C may be equal.

For another example, the clutch 120 having the planetary gear assembly may be replaced with an electromagnetic clutch. For another example, the image forming apparatus may be equipped with development-gear trains not including clutches.

For another example, the endless belt in the image forming apparatus may not necessarily be provided to serve as the conveyer belt 73 but may be provided to serve as, for example, an intermediate transfer belt. For another example, the conveyer belt 73 may not necessarily be driven by the process motor 3P, which drives the photosensitive drum 50, but may be driven by a different motor such as, for example, a dedicated motor for driving the belt.

For another example, the cleaning roller 91 may not necessarily be driven by the process motor 3P, which drives the photosensitive drum 50, but may be driven by a different motor such as, for example, a dedicated motor for driving the cleaning roller. For another example, moreover, the image forming apparatus may not necessarily be equipped with the cleaning roller 91.

For another example, the moving mechanism 5 may be equipped with a linear motion cam in place of the rotatable cam 150. For another example, the developing roller 61 may not necessarily be movable in the front-rear direction to move between the contacting position and the separated position but may be movable vertically to move between the contacting position and the separated position.

For another example, the first and second development-gear trains 100A, 100B may not necessarily be in the arrangement such that the first development-gear train 100A transmits the driving force from the development motor 3D to two (2) of the Y-, M-, C-, K-developing rollers 61Y, 61M, 61C, 61K, i.e., the Y- and M-developing rollers 61Y, 61M, and the second development-gear train 100B transmits the driving force from the development motor 3D to the other two (2) of the Y-, M-, C-, K-developing rollers 61Y, 61M, 61C, 61K, i.e., the C- and K-developing rollers 61C, 61K. The first development-gear train may transmit the driving force from the development motor to three (3) or more of the developing rollers, and the second development-gear train may transmit the driving force from the development motor to the equal quantity of the developing rollers to the quantity of the developing roller, to which the first development-gear train may transmit the driving force from the development motor. The first and second process-gear trains may be arranged similarly.

For another example, the image forming apparatus may be a multifunction peripheral machine or a copier.

For another example, the items illustrated in the embodiment and the modified examples may optionally be combined.

What is claimed is:

1. An image forming apparatus, comprising:

a first photosensitive drum;

a second photosensitive drum;

a third photosensitive drum;

a fourth photosensitive drum;

a first developing roller configured to supply toner to the first photosensitive drum;

a second developing roller configured to supply toner to the second photosensitive drum;

a third developing roller configured to supply toner to the third photosensitive drum;

a fourth developing roller configured to supply toner to the fourth photosensitive drum;

a development-driving gear;

a development motor configured to drive the development-driving gear;

a first development-gear train having a first gear meshing directly with the development-driving gear, the first development-gear train being configured to transmit a driving force from the development motor to the first developing roller and the second developing roller;

a second development-gear train having a second gear meshing directly with the development-driving gear, the second development-gear train being configured to transmit the driving force from the development motor to the third developing roller and the fourth developing roller, the second development-gear train being provided separately from the first development-gear train;

a process-driving gear;

a process motor configured to drive the process-driving gear;

a first process-gear train having a third gear meshing directly with the process-driving gear, the first process-gear train being configured to transmit a driving force from the process motor to the first photosensitive drum and the second photosensitive drum; and a second process-gear train having a fourth gear meshing directly with the process-driving gear, the second process-gear train being configured to transmit the driving force from the process motor to the third photosensitive drum and the fourth photosensitive drum, the second process-gear train being provided separately from the first process-gear train.

2. The image forming apparatus according to claim 1, wherein the first development-gear train includes:

a first clutch configured to switch between an engaging state, in which the first clutch engages transmission of the driving force input through the first gear to the first developing roller, and a disengaging state, in which the first clutch disengages transmission of the driving force input through the first gear to the first developing roller; and a second clutch configured to switch between an engaging state, in which the second clutch engages transmission of the driving force input through the first gear to the second developing roller, and a disengaging state, in which the second clutch disengages transmission of the driving force input through the first gear to the second developing roller, and wherein the second development-gear train includes:

a third clutch configured to switch between an engaging state, in which the third clutch engages transmission of the driving force input through the second gear to the third developing roller, and a disengaging state, in which the third clutch disengages transmission of the driving force input through the second gear to the third developing roller; and a fourth clutch configured to switch between an engaging state, in which the fourth clutch engages transmission of the driving force input through the second gear to the fourth developing roller, and a disengaging state, in which the fourth clutch disengages transmission of the driving force input through the second gear to the fourth developing roller.

3. The image forming apparatus according to claim 1, further comprising:

an endless belt arranged to contact the first photosensitive drum, the second photosensitive drum, the third photosensitive drum, and the fourth photosensitive drum; and a belt-gear train having a fifth gear meshing directly with one of a gear forming a part of the first process-gear train and a gear forming a part of the second process-gear train, the belt-gear train being configured to transmit the driving force from the process motor to the endless belt.

4. The image forming apparatus according to claim 3, further comprising:

a cleaning roller contacting the endless belt, the cleaning roller being configured to collect adhering particles from the endless belt; and a cleaning-gear train having a sixth gear meshing directly with a gear attached to an output shaft of the process motor, the cleaning-gear train being configured to transmit the driving force from the process motor to the cleaning roller.

5. The image forming apparatus according to claim 3, further comprising:

a cleaning roller contacting the endless belt, the cleaning roller being configured to collect adhering particles from the endless belt; and a cleaning-gear train having a sixth gear meshing directly with the process-driving gear, the cleaning-gear train being configured to transmit the driving force from the process motor to the cleaning roller.

6. The image forming apparatus according to claim 1, further comprising:

an endless belt arranged to contact the first photosensitive drum, the second photosensitive drum, the third photosensitive drum, and the fourth photosensitive drum; and a belt-gear train having a fifth gear meshing directly with the process-driving gear, the belt-gear train being configured to transmit the driving force from the process motor to the endless belt.

7. The image forming apparatus according to claim 6, further comprising:

a cleaning roller contacting the endless belt, the cleaning roller being configured to collect adhering particles from the endless belt; and a cleaning-gear train having a sixth gear meshing directly with a gear attached to an output shaft of the process motor, the cleaning-gear train being configured to transmit the driving force from the process motor to the cleaning roller.

8. The image forming apparatus according to claim 6, further comprising:

a cleaning roller contacting the endless belt, the cleaning roller being configured to collect adhering particles from the endless belt; and a cleaning-gear train having a sixth gear meshing directly with the process-driving gear, the cleaning-gear train being configured to transmit the driving force from the process motor to the cleaning roller.

9. The image forming apparatus according to claim 1, wherein the first development-gear train includes:

a first output gear configured to output the driving force input through the first gear to the first developing roller; and a second output gear configured to output the driving force input through the first gear to the second developing roller, wherein the second development-gear train includes a third output gear configured to output the driving force input through the second gear to the third developing roller, and wherein a quantity of gears intervening between the first gear and the first output gear, a quantity of gears intervening between the first gear and the second output gear, and a quantity of gears intervening between the second gear and the third output gear are equal.

10. The image forming apparatus according to claim 9, wherein the second development-gear train includes a fourth output gear configured to output the driving force input through the second gear to the fourth developing roller, and wherein a quantity of gears intervening between the second gear and the fourth output gear is greater than the quantity of the gears intervening between the second gear and the third output gear.

11. The image forming apparatus according to claim 1, wherein the process-driving gear meshes directly with a gear attached to an output shaft of the process motor.

12. The image forming apparatus according to claim 1, wherein the process-driving gear is a gear attached to an output shaft of the process motor.

13. The image forming apparatus according to claim 1, wherein the development-driving gear is a gear attached to an output shaft of the development motor.

* * * * *